US007628392B2

(12) United States Patent
Shiohara et al.

(10) Patent No.: US 7,628,392 B2
(45) Date of Patent: Dec. 8, 2009

(54) SHEET FEED DEVICE AND IMAGE RECORDING APPARATUS HAVING SUCH SHEET FEED DEVICE

(75) Inventors: Yukio Shiohara, Nagoya (JP); Tetsuo Asada, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 479 days.

(21) Appl. No.: 11/277,610

(22) Filed: Mar. 27, 2006

(65) Prior Publication Data

US 2006/0163796 A1 Jul. 27, 2006

(30) Foreign Application Priority Data

Mar. 30, 2005 (JP) ..... 2005-099611
Mar. 24, 2006 (JP) ..... 2006-083192

(51) Int. Cl.
*B65H 3/44* (2006.01)

(52) U.S. Cl. ..... 271/9.08; 271/9.07; 271/9.11; 271/111

(58) Field of Classification Search ..... 271/9.07, 271/111, 117, 9.05, 9.06, 9.08, 9.11, 145, 271/162, 164, 171, 9.12
See application file for complete search history.

(56) References Cited

U.S. PATENT DOCUMENTS 4,108,427 A * 8/1978 Komori et al. ..... 271/9.09
4,279,504 A * 7/1981 Brown et al. ..... 355/72
4,303,235 A * 12/1981 Calabrese ..... 271/162
4,449,705 A * 5/1984 Shibuya et al. ..... 271/9.09
4,538,799 A * 9/1985 Bhagwat ..... 271/9.08
4,838,535 A * 6/1989 Yokoi et al. ..... 271/22
4,991,830 A * 2/1991 Yamanaka ..... 271/9.08
5,085,419 A * 2/1992 Bell ..... 271/9.07
5,120,040 A * 6/1992 Worley ..... 271/9.07
5,287,164 A * 2/1994 Watanabe ..... 399/391
5,478,162 A * 12/1995 Nakayama et al. ..... 400/605

(Continued)

FOREIGN PATENT DOCUMENTS

JP 3095038 A 4/1991

(Continued)

*Primary Examiner*—Patrick H Mackey
*Assistant Examiner*—Jeremy Severson
(74) *Attorney, Agent, or Firm*—Baker Botts, LLP

(57) ABSTRACT

A sheet feed device includes a first sheet cassette including an accommodating portion configured to accommodate a first plurality of sheets, and a second sheet cassette disposed on the first sheet cassette and including a holding portion configured to hold a second plurality of sheets, in which one or more characteristics of the first plurality of sheets is different than one or more characteristics of the second plurality of sheets. The sheet feed device also includes a sheet feeder including a sheet feed roller, and the sheet feed device is configured to selectively feed the first plurality of sheets and the second plurality of sheets in a sheet feed direction toward a recording unit. Moreover, the sheet feed device includes a sheet separator configured to separate, one by one, the sheets fed by the sheet feeder. Specifically, the second sheet cassette is configured to move above the accommodating portion of the first sheet cassette and with respect to the sheet feeder, and the sheet feed roller is configured to contact the second plurality of sheets on the holding portion that is inclined so as to increase in height in a direction toward the sheet separator.

22 Claims, 20 Drawing Sheets

U.S. PATENT DOCUMENTS

| | | | | |
|---|---|---|---|---|
| 5,737,682 | A * | 4/1998 | Yamagishi | 399/402 |
| 6,152,440 | A * | 11/2000 | Yip et al. | 271/9.11 |
| 6,169,557 | B1 * | 1/2001 | Suzuki et al. | 347/104 |
| 6,179,499 | B1 * | 1/2001 | Beretta et al. | 400/605 |
| 6,315,280 | B1 * | 11/2001 | Jang | 271/9.02 |
| 6,406,201 | B1 * | 6/2002 | Beretta et al. | 400/605 |
| 6,659,443 | B1 * | 12/2003 | Eskey | 271/9.08 |
| 6,659,444 | B2 * | 12/2003 | Kawarama | 271/9.09 |
| 7,413,183 | B2 * | 8/2008 | Asada et al. | 271/117 |
| 2004/0169327 | A1 * | 9/2004 | Swayze et al. | 271/145 |
| 2006/0261535 | A1 * | 11/2006 | Shiohara et al. | 271/9.01 |
| 2007/0075476 | A1 * | 4/2007 | Shiohara | 271/9.01 |
| 2007/0075477 | A1 * | 4/2007 | Shiohara | 271/9.08 |

FOREIGN PATENT DOCUMENTS

| | | | |
|---|---|---|---|
| JP | 6100190 | A | 4/1994 |
| JP | 649439 | U | 7/1994 |
| JP | 3025763 | U | 4/1996 |
| JP | 11059925 | A | 3/1999 |
| JP | 11314773 | A | 11/1999 |
| JP | 2002249242 | A | 3/2003 |

* cited by examiner

SHEET FEED DEVICE AND IMAGE RECORDING APPARATUS HAVING SUCH SHEET FEED DEVICE

CROSS REFERENCE TO RELATED APPLICATION

The present application claims priority from Japanese Patent Application No. 2005-99611, which was filed on Mar. 30, 2005, the disclosure of which is incorporated herein by reference in its entirety.

BACKGROUND OF THE INVENTION

1. Field of the Invention

The present invention relates generally to a sheet feed device that includes a first sheet cassette and a second sheet cassette disposed on the first sheet cassette, and selectively feeds sheets (recording media) that are positioned in the first sheet cassette or sheets that are positioned in the second sheet cassette and are different than, e.g., smaller than, the sheets in the first sheet cassette. The present invention also relates to an image recording apparatus having such a sheet feed device.

2. Description of Related Art

A sheet feed device used in a known image recording apparatus, such as a printer and/or a facsimile machine, is disclosed, for example, in Japanese Laid-Open Patent Publication No. 2002-249242. In this known sheet feed device, the sheet cassette for accommodating a stack of recording media (such as recording sheets and cut sheets) is disposed in a lower side of the apparatus body (housing). The sheet cassette is movable into and from the housing. A drive shaft is disposed above the sheet cassette so as to extend in a direction perpendicular to the sheet feed direction. A sheet feed arm is pivotally attached to the drive shaft, and a free end of the sheet feed arm extends toward an inclined separation plate that is provided at one end of the sheet feed cassette. A sheet feed roller is attached to the free end of the sheet feed arm, and power for rotating the sheet feed roller is transmitted from the dive shaft via a power-transmitting unit disposed at the sheet feed arm. The sheet feed roller is urged by a spring to abut the uppermost sheet surface regardless of the height of the sheets stacked in the sheet cassette.

In this known sheet feed device, the inclination angle of the sheet feed arm with respect to the uppermost sheet surface, that is, an angle formed by the uppermost sheet surface with a line between the pivot center of sheet feed arm (axial center of the drive shaft) and a point where the sheet feed roller contacts the uppermost sheet surface varies depending on the height of the sheets stacked in the sheet cassette. When the inclination angle of the sheet feed arm is smaller than a predetermined value, a force of the sheet feed roller applied to the uppermost sheet surface is insufficient to feed the uppermost sheet,

SUMMARY OF THE INVENTION

Therefore, a need has arisen for sheet feed devices that overcome these and other shortcomings of the related art. A technical advantage of the present invention is that the sheet feed device has relatively simple structure, and may selectively feed different types of sheets, e.g., sheets having different sizes, in a stable manner from two sheet cassettes arranged one on top of the other.

According to an embodiment of the invention, a sheet feed device comprises a first sheet cassette comprising an accommodating portion configured to accommodate a first plurality of sheets, and a second sheet cassette disposed on the first sheet cassette and comprising a holding portion configured to hold a second plurality of sheets, in which at least one characteristic of the first plurality of sheets is different than at least one characteristic of the second plurality of sheets. The sheet feed device also comprises a sheet feeder that comprises a sheet feed roller and is configured to selectively feed the first plurality of sheets and the second plurality of sheets in a sheet feed direction toward a recording unit. Moreover, the sheet feed device comprises a sheet separator configured to separate, one by one, the sheets fed by the sheet feeder. Specifically, the second sheet cassette is configured to move above the accommodating portion of the first sheet cassette and with respect to the sheet feeder, and the sheet feed roller is configured to contact the second plurality of sheets on the holding portion that is inclined so as to increase in height in a direction toward the sheet separator.

According to another embodiment of the present invention, a sheet feed device comprises a first sheet cassette comprising an accommodating portion configured to accommodate a first plurality of sheets, and a second sheet cassette disposed on the first sheet cassette, in which the second sheet cassette comprises a holding portion configured to hold a second plurality of sheets, and at least one characteristic of the first plurality of sheets is different than at least one characteristic of the second plurality of sheets. The sheet feed device also comprises a first sheet feeder configured to feed the first plurality of sheets in a sheet feed direction toward a recording unit, and a second sheet feeder disposed side by side with the first sheet feeder in a direction perpendicular to the sheet feed direction, in which the second sheet feeder is configured to feed the second plurality of sheets in the sheet feed direction to the recording unit. Moreover, each of the first sheet feeder and the second sheet feeder comprises a drive shaft extending in the direction perpendicular to the sheet feed direction a sheet feed arm extending from the drive shaft in the sheet feed direction, and a sheet feed roller provided at an end of the sheet feed arm. Specifically, a first length of the sheet feed arm of the second sheet feeder is less than a second length of the sheet feed arm of the first sheet feeder.

According to yet another embodiment of the present invention, either one of the above-described sheet feed devices may be incorporated into an image recording apparatus. In this embodiment of the present invention, the image recording apparatus comprises a housing, a recording unit that records an image on a sheet, and a sheet feed path through which the sheet is fed to the recording unit. The recording unit, the sheet feed path, and the sheet feeder of the sheet feed device are accommodated in the housing. The first and the second sheet cassettes of the sheet feed device are disposed at a lower position than the recording unit, and are configured to move inward and outward with respect to the housing.

Other advantages of the present invention will be apparent to persons of ordinary skill in the art in view of the following detailed description of the invention and the accompanying drawings.

BRIEF DESCRIPTION OF THE DRAWINGS

For a more complete understanding of the present invention, and the needs satisfied thereby, reference now is made to the following descriptions taken in connection with the accompanying drawings.

DETAILED DESCRIPTION OF PREFERRED EMBODIMENTS

Preferred embodiments of the present invention may be understood by referring to FIGS. 1-20, like numerals being used for like corresponding parts in the various drawings.

Figure 1:
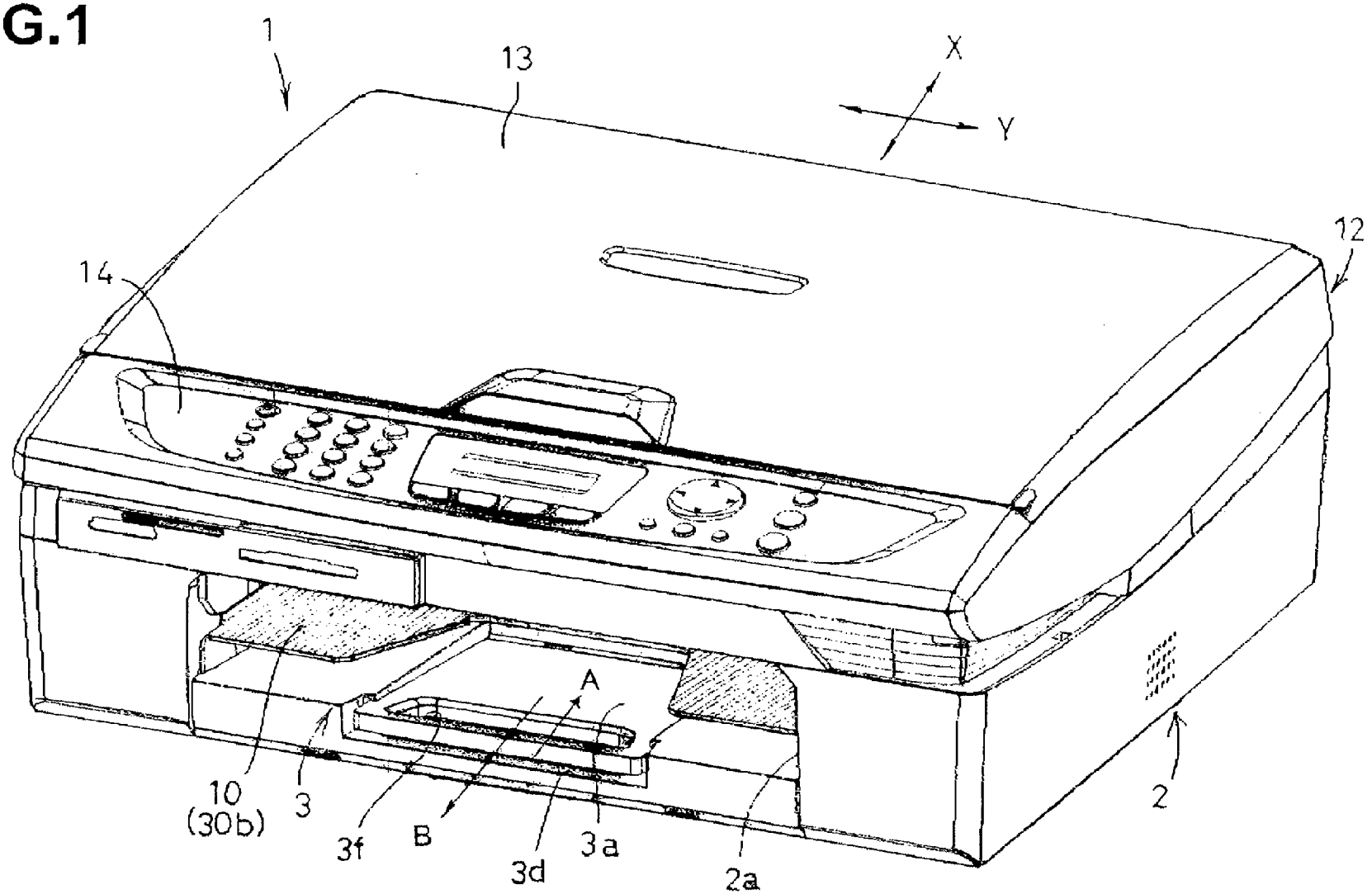
FIG. 1 is a perspective view of an image recording apparatus.
Figure 2:
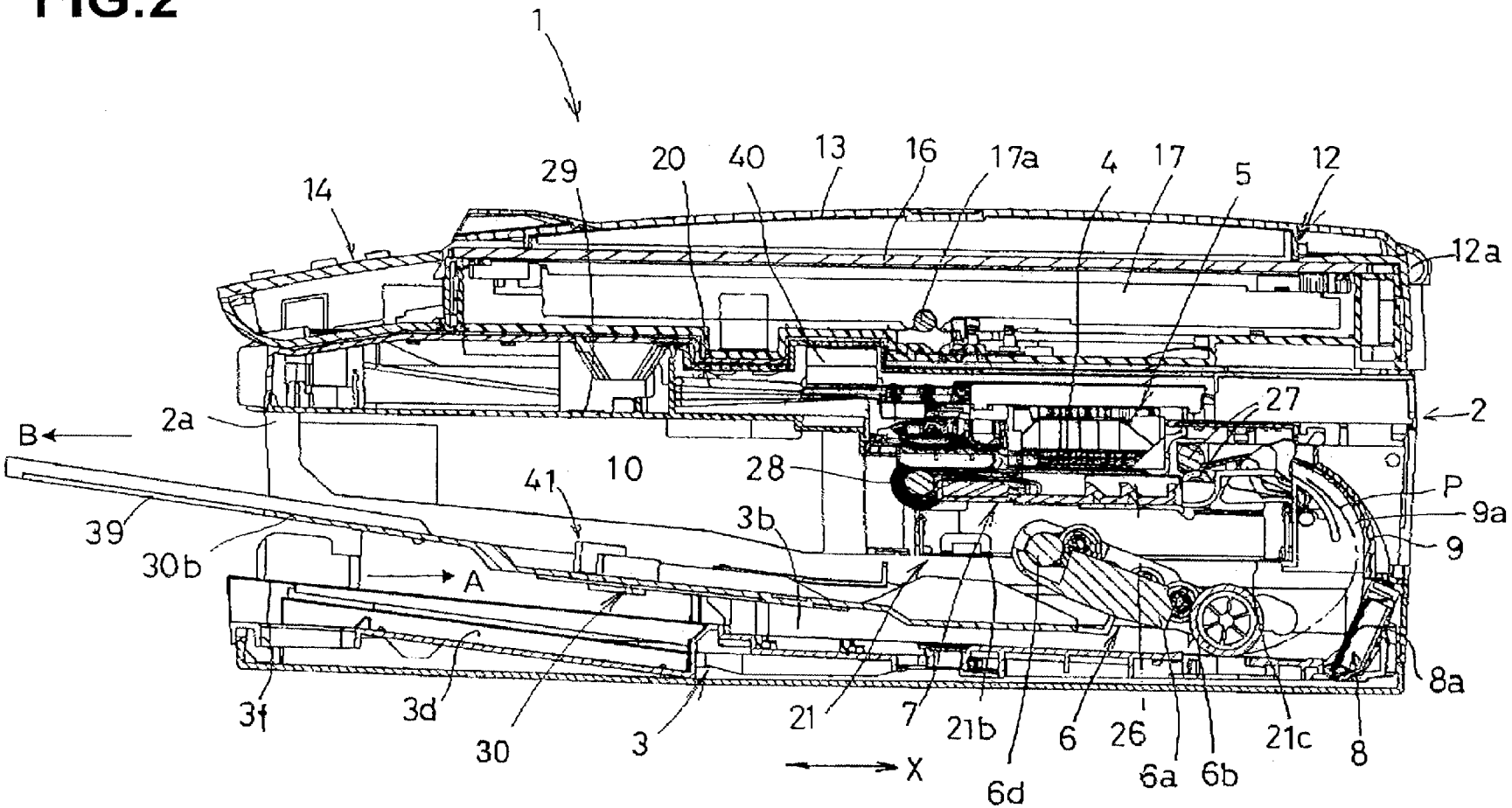
FIG. 2 is a side cross-sectional view of the image recording apparatus.

FIG. 1 shows an image recording apparatus 1 according to an embodiment of the present invention. Image recording apparatus 1 may be a multi-function device (MFD) that has printing, copying, scanning, and facsimile functions. As shown in FIGS. 1 and 2, image recording apparatus 1 may have a housing 2 as a main body of the apparatus. Housing 2 may be formed by injection-molding of a synthetic resin material. A first sheet cassette 3, which can be inserted from an opening 2*a* at the front of housing 2 (on the left in FIG. 2), may be disposed at the bottom of housing 2. A second sheet cassette 30 may be movably connected to or placed on an upper surface of first sheet cassette 3. Hereinafter, a side on which opening 2*a* is located is referred to as a "front" side of image recording apparatus 1, and a side opposite from opening 2*a* is referred to as a "rear" side of image recording apparatus 1.

On an upper portion of housing 2, an image reading device 12 may be disposed for reading a document during the copying and facsimile operation of image recording apparatus 1. Image reading device 12 may be arranged to be pivotable upward and downward about one end of housing 2 via hinges (not shown). A document cover member 13 may be connected at its rear end to a rear end of image reading device 12 via hinges 12*a* so as to be pivotable upward and downward about hinges 12*a*.

An operation panel 14 provided with various operation buttons and a liquid crystal display may be disposed on an upper side of housing 2, on a front side of image reading device 12. A glass plate 16 may be provided or on an upper surface of image reading device 12. A document may be placed on glass plate 16 by opening document cover member 13 in a upward direction. Below glass plate 16, an image scanning device (CIS: Contact Image Sensor) for reading an image on the document may be provided so as to be reciprocally movable along a guide shaft 17*a* that extends in a direction perpendicular to a sheet plane of FIG. 2 (a main scanning direction or a Y-axis direction in FIGS. 1, 2, and 3).

Below image reading device 12 and operation panel 14, a recording unit 7, a sheet discharge portion 10, and an ink storage portion 15 disposed on one side of sheet discharge portion 10 may be located within a projected area of image reading device 1 and operation panel 14.

Figure 3:
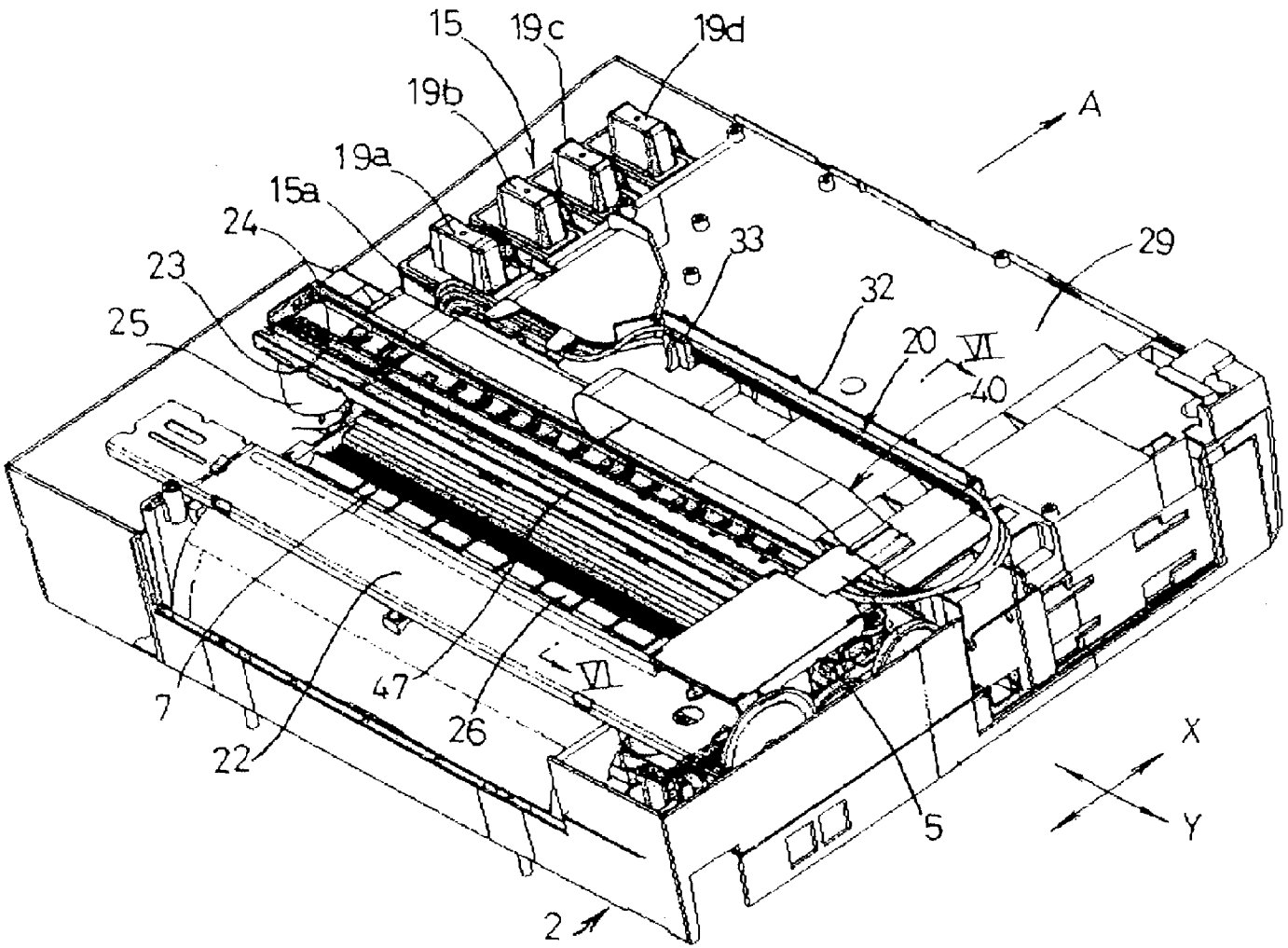
FIG. 3 is a perspective view of a recording device exposed when an image reading device is removed.

As shown in FIGS. 2 and 3, recording unit 7 may be defined by a main frame 21 having an upwardly open box structure, and a first guide member 22 and a second guide member 23 that comprise elongate plates supported by side plates of main frame 21 and extend in the Y-axis direction (main scanning direction). A carriage 5, on which a recording head 4 of recording unit 7 may be mounted may be supported by first guide member 22 located upstream of carriage 5 as seen in a sheet discharge direction (indicated by arrow B) the second guide member 23 located downstream of carriage 5 so as to be slidably movable on first guide member 22 and second guide member 23. Thus, carriage 5 may be reciprocally movable in the Y-axis direction.

In order to reciprocally move carriage 5, a timing belt 23 may be disposed on an upper surface of the second guide member 23 as seen in the sheet discharge direction. Timing belt 24 extends in the main scanning direction (Y-axis direction) and is wound around pulleys. A carriage motor 25 (FIG. 3) to drive timing belt 24 may be fixed to a lower surface of second guide member 23. Carriage motor 25 may be a DC motor, a stepping motor, or the like. Second guide member 23 may be provided with an encoder strip 47 that extends in the main scanning direction and detects the position of carriage 5 in the Y-axis direction (main scanning direction). Encoder strip 47 may be belt-shaped, and a detecting surface of encoder strip 47 may be formed with slits at regular intervals in the Y-axis direction and may be disposed along a vertical direction.

A platen 26; may have a flat shape and may extend in the Y-axis direction so as to face an underside of recording head 4 on carriage 5. Platen 26 may be fixed above a bottom plate 21*b* of main frame 21 between first guide member 22 and second guide member 23.

As shown in FIGS. 2 and 3, a partition plate 29, e.g., a plate made of a synthetic resin, may be formed integrally with housing 2 so as to extend from a lower surface of second guide member 23 to opening 2*a* (used also as a sheet-discharge opening) at the front end of housing 2 to cover sheet discharge portion 10.

Ink storage portion 15 may be open upward of housing 2, and may accommodate, for full-color recording, ink cartridges 19 (black, cyan, magenta, and yellow ink cartridges 19*a*-19*d* in FIG. 3), which may be detachably attached from above to ink storage portion 15 in a row along the X-axis direction. Each of ink cartridges 19 may have a rectangular box shape and may have a relatively small area (as seen in plan view) and a relatively large height.

Ink may be supplied from ink cartridges 19*a*-19*d* to inkjet-type recording head 4 though a plurality of ink tubes 20, e.g., four ink tubes. When more than four ink colors are used e.g., six to eight ink colors, ink storage portion 15 may be designed to accommodate ink cartridges corresponding in number to the number of ink colors, and ink tubes 20 may be increased in number corresponding to the number of ink cartridges.

As shown in FIG. 3, root portions of the plurality of ink tubes 20 may be bounded to one end 15*a* of ink storage portion 15, and may extend from one side (left side in FIG. 3) to the other side (right side in FIG. 3) along the Y-axis direction. The root portions of ink tubes 20 may be arranged horizontally in a row along an upper surface of partition plate 29, which may be substantially horizontal. At least one portion e.g., intermediate portions, of ink tubes 20 may be supported by the upper surface of partition plate 29.

Then, ink tubes 20 may be twisted, e.g., at their middle portions, to extend along a vertical side surface of a laterally elongated upright partition plate 32 of partition plate 29, and may be secured, e.g., held or sandwiched, in a row vertically between the vertical side surface of upright partition plate 32 and a holder 33, which may be made of a synthetic resin, into a vertical plate and fixed with a screw or the like to face the vertical side surface. Holder 33 and upright partition plate 32 serve as an intermediate holder to secure (hold) ink tubes 20.

An ink receiver (not shown) may be disposed at one side of recording unit 7 at the outside of the width (shorter side) of a sheet P to be fed, and a maintenance unit (not shown) may be disposed at the other side thereof. The ink receiver receives the ink ejected from recording head 4 when ink ejection is performed periodically to prevent the nozzle from clogging during recording operation at a flashing position provided to face the ink receiver. The maintenance unit performs maintenance of recording head 4 when carriage 5 is at a stand-by position. The maintenance unit covers the nozzle surface of recording head 4 from the bottom with its cap portion (not shown) and selectively sucks each color ink or eliminates air bubbles from a buffer tank (not shown) above recording bead 4. When carriage 5 moves sideways toward the maintenance unit, a cleaner, e.g., a wiper blade, wipes the nozzle surface.

As shown in FIG. 3, according to one embodiment of the present invention, a flexible flat cable 40, which transfers command signals for selective ink ejection from the nozzles of recording head 4 from a control portion provided in housing 2 to recording head 4, may be arranged substantially in parallel with the extending direction of ink tubes 20, at an area where ink tubes 20 pass when carriage 5 moves reciprocally in the Y-axis direction, i.e., at a movable or non-bundled area of ink tubes 20.

Intermediate bent portions of ink tubes 20 and an intermediate bent portion of flexible flat cable 40 may protrude in opposite directions with respect to the reciprocally moving direction of carriage 4. This arrangement allows ink tubes 20 and flexible flat cable 40 to be located at substantially the same height in the vertical direction, that is, on a substantially same horizontal plane. Thus, image recording apparatus 1 may be relatively thin.

As shown in FIG. 2, a pair of register rollers, e.g., transport rollers, may be disposed upstream of the platen 26 as seen in the sheet discharge direction to feed the sheet P to the underside of recording head 4, and a discharge roller 28 may be disposed downstream of platen 26 to discharge the printed sheet P to sheet discharge portion 10.

The structure of a sheet feed device 100 according to a first embodiment of the present invention will now be described. In this embodiment, sheet feed device 100 comprises a first sheet cassette 3 and a second sheet cassette 30. First sheet cassette 3 has an accommodating portion 3*b* configured to accommodate a stack of sheets P, and sheets P in accommodating portion 3*b* may be fed in a sheet feed direction (indicated by arrow A) toward recording unit 7 one by one by a sheet feeder 6. Second sheet cassette 30 may be disposed above accommodating portion 3*b* and may be movable back and forth with respect to sheet feeder 6. Second sheet cassette 30 may be configured to accommodate a stack of sheets P1 that are different in size from the sheets P accommodated in first sheet cassette 3, e.g., sheets P1 may be smaller-sized sheets, such as postcards and L-sized photograph sheets. The sheets P1 in second sheet cassette 30 may be fed in the same direction as the feed direction of the sheets P. When second sheet cassette 30 is moved back (pulled back) with respect to first sheet cassette 3 in a direction opposite to the sheet feed direction, that is, in the sheet discharge direction, an upstream end of second sheet cassette 30 is positioned behind (upstream of) an upstream end of first sheet cassette 3 as seen in the sheet feed direction.

Figure 4:
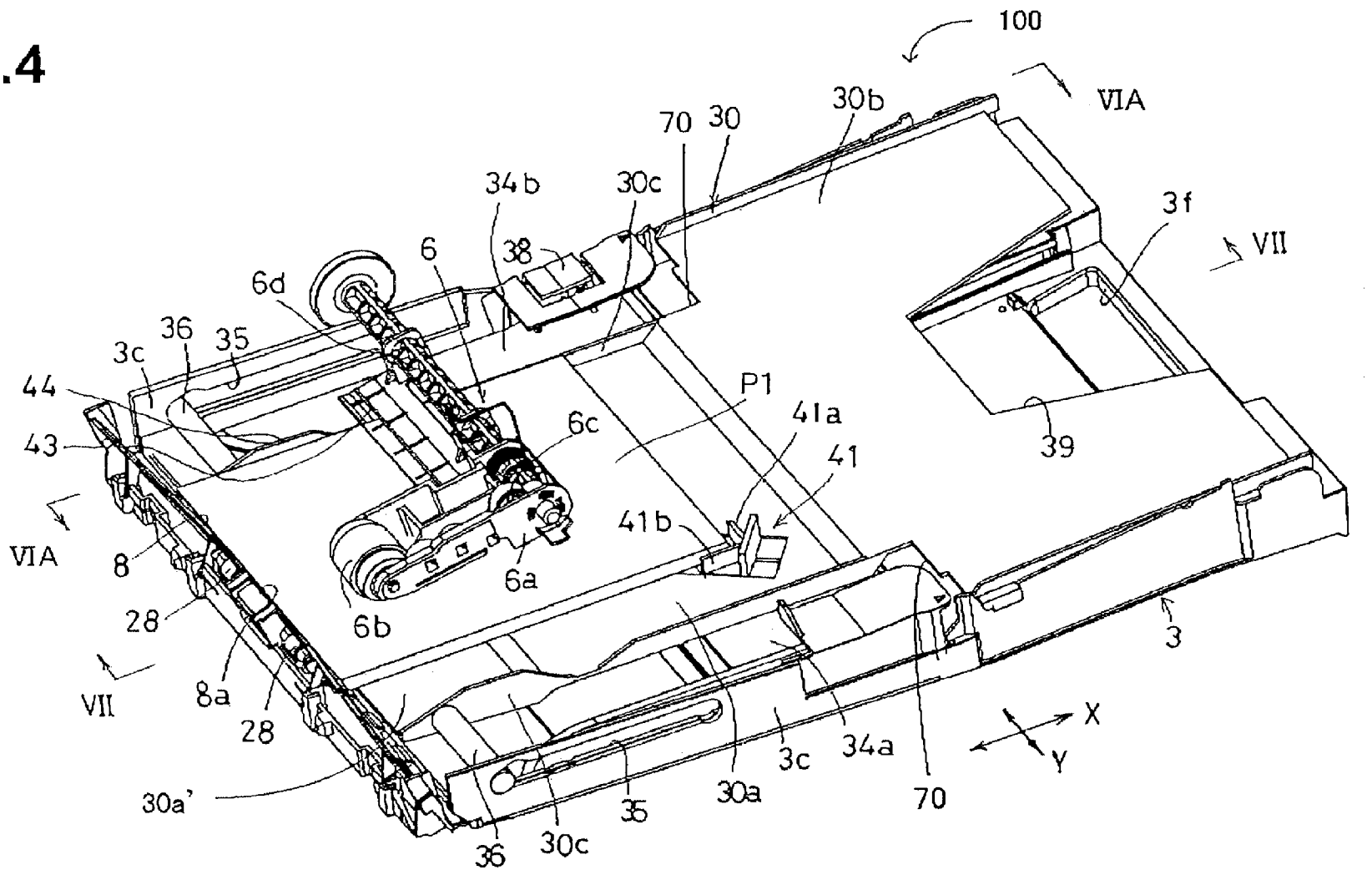
FIG. 4 is a perspective view of a sheet feed device according to a first embodiment of the present invention, in which a second sheet cassette is set at a sheet feed position on a first sheet cassette.
Figure 5:
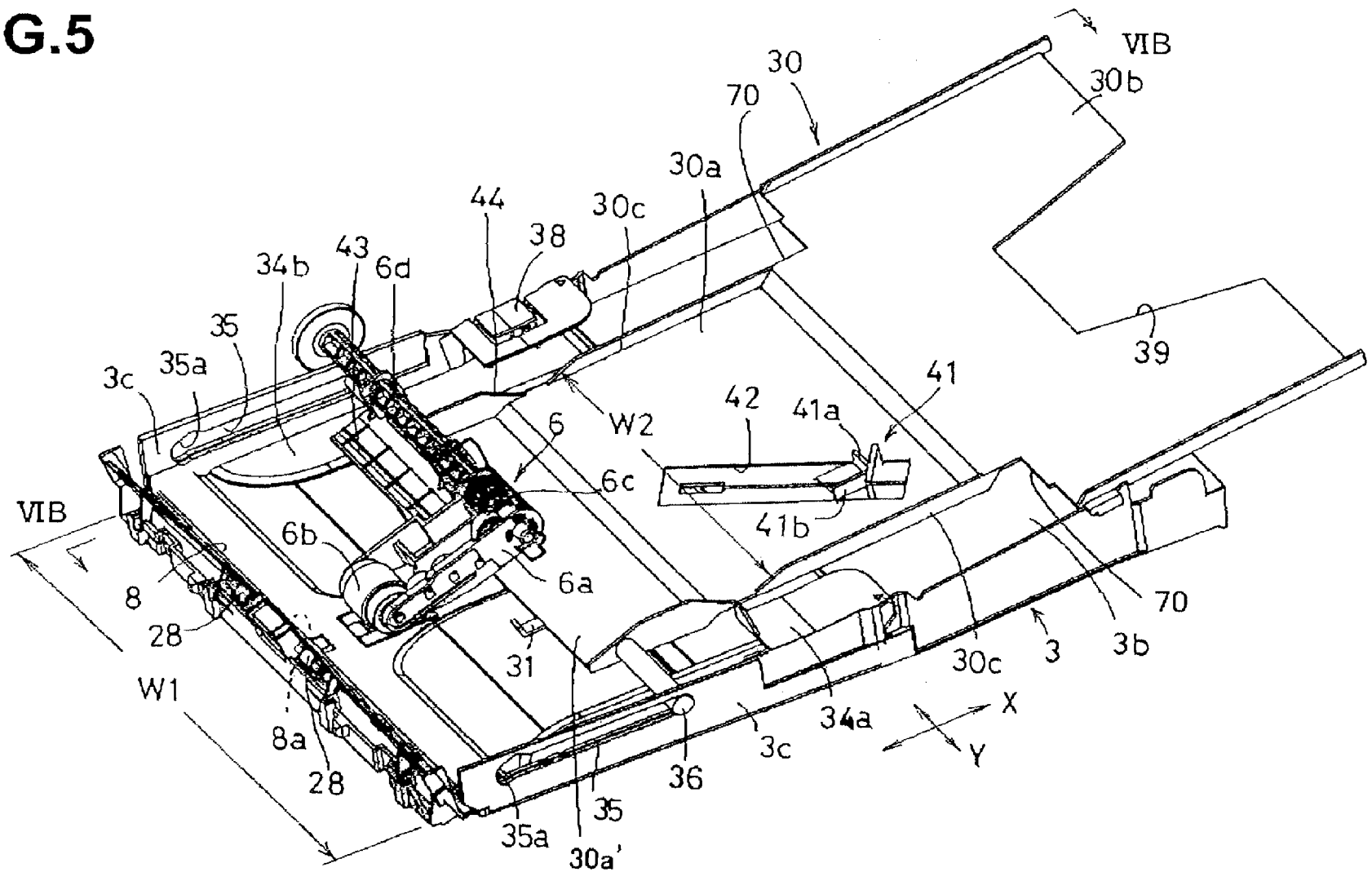
FIG. 5 is a perspective view of the sheet feed device in which the second sheet cassette is moved back to a non-sheet-feed position.

As shown in FIGS. 2, 4, and 5, a drive shaft 6*d* made of a synthetic resin may be rotatably supported by shaft holes formed in a side plate (not shown) and a pair of shaft supporting plates (not shown) of main frame 21. Drive shaft 6*d* may be inserted into the shaft holes, such that an end of drive shaft 6*d* projects sideways from a base portion of a sheet feed arm 6*a*. When drive shaft 6*d* is driven to rotate, sheet feed roller 6*b* may rotate in a predetermined direction (counterclockwise direction in FIG. 2) via a gear transmission mechanism 6*c* provided in sheet feed arm 6*a*. Sheet feed roller 6*b* may be urged downward by an urging member, e.g., a torsion spring (not shown).

First sheet cassette 3 may be configured to accommodate a stack of larger cut sheets P, such as A4-sized sheets, lettersized sheets, and legal-sized sheets, such that a shorter side of the cut sheet P extends in the Y-axis direction (main scanning direction). In this embodiment of the present invention, the maximum capacity of the accommodating portion 3*b* of the first sheet cassette 3 may be about 100 sheets of plain paper, or a stack having a height of about 10 mm. As shown in FIG. 1, an auxiliary support member 3*a* may be provided movably in the sheet feed direction (sub scanning direction or X-axis direction) in a recess 3*d* at an upstream end of first sheet cassette 3 as seen in the sheet feed direction (at a front side of housing 2) to support the trailing edges of longer sheets, such as legal-sized sheets. As shown in FIGS. 1, 4, 8A, and 8B, a trapezoidal hole may be formed near the upstream end of auxiliary support member 3*a* to provide a grip 3*f* with which first sheet cassette 3 can be readily inserted and removed through opening 2*a* of housing 2.

A main inclined separation plate 8 for separating one sheet from the others may be disposed at a downstream end (on the right side in FIG. 2) of first sheet cassette 3 as seen in the sheet feed direction. The sheets P stacked in first sheet cassette 3 are separated one by one by the sheet feed roller 6*b* and an elastic separation pad 8*a* (formed by a metal spring in this embodiment) provided on an inner surface and at the center in the width direction (Y-axis direction) of inclined separation plate 8. The separated sheet P is fed, via a sheet feed path member 9 that defines a U-turn path (sheet feed path) 9*a* extending upward, to recording unit 7 located at a higher position than first sheet cassette 3. Then, the sheet P recorded thereon by recording unit 7 may be discharged to discharge portion 10 communicating with opening 2*a*, with the recorded surface facing upward.

Figures 8A, 8B:
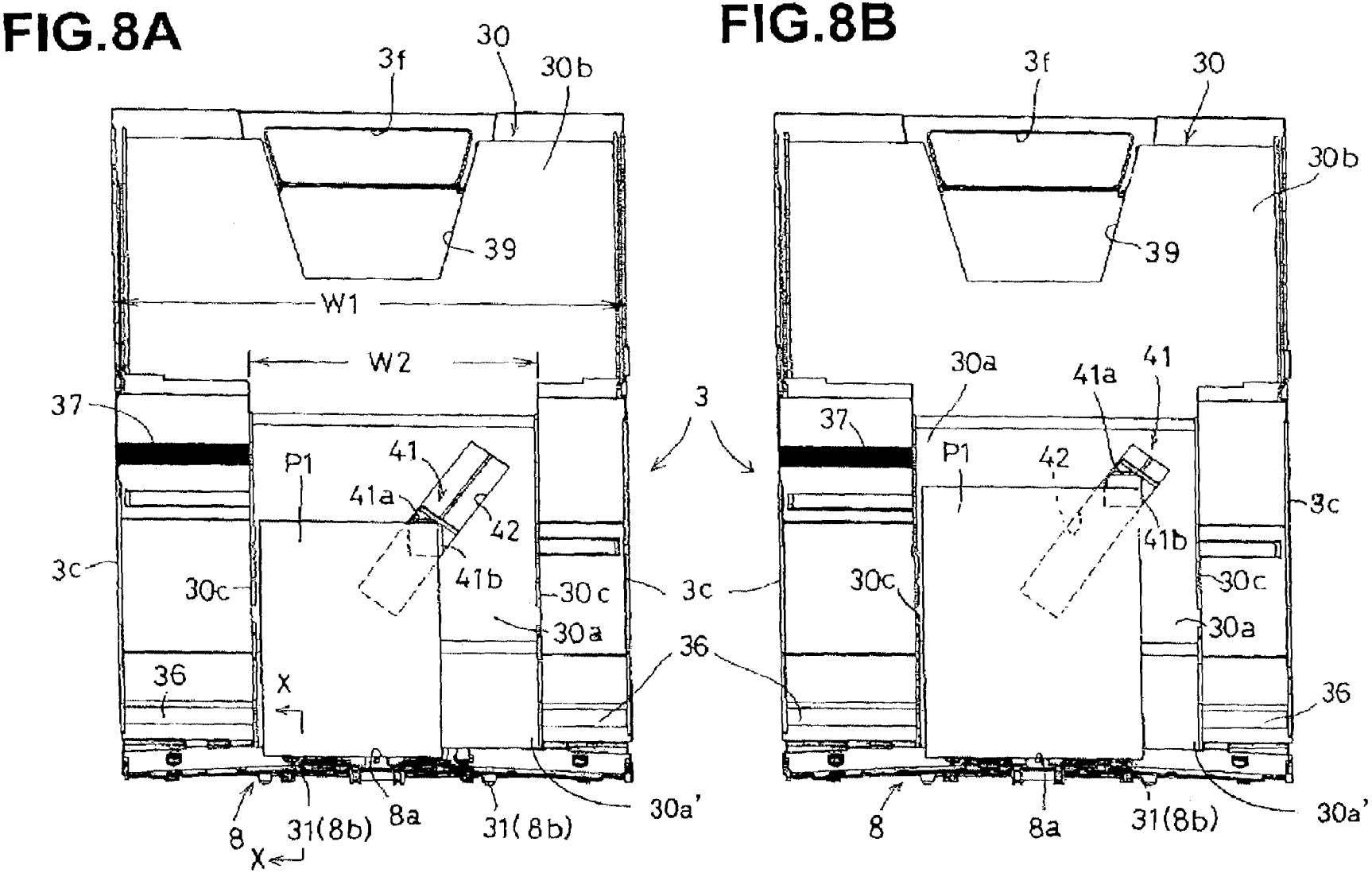
FIG. 8A is a plan view showing a state where a slant (rear corner) guide is used in the second sheet cassette.
FIG. 8B is a plan view showing another state where the slant guide is used in the second sheet cassette.

As shown in FIGS. 4, 8A, and 8B, main inclined separation plate 8 may have a curved surface such that, as seen in a direction perpendicular to the sheet feed direction a portion near elastic separation pad 8*a* in the form of a sawtooth is closer to the widthwise center of a leading edge of the sheet P and is more remote from the widthwise ends of the leading edge of the sheet P. Thus, before the leading edge of the sheet P comes into contact with main inclined separation plate 8 at the widthwise ends, the leading edge of the sheet P comes in sliding contact with elastic separation pad 8*a* at the widthwise center, and thereby the sheet P is reliably separated. As shown in FIGS. 4 and 5, freely rotatable rollers 28 may be provided adjacent to an upper end of main inclined separation plate 8 on both sides of elastic separation pad 8*a* to guide the sheet P smoothly to sheet feed path member 9. Main inclined separation plate 8 may be detachably attached to the downstream end of first sheet cassette 3 as seen in the sheet feed direction.

A pair of left and right side guides 34*a*, 34*b*, respectively, may be provided in accommodating portion 3*b* of first sheet cassette 3, as a guide unit, and may be movable in a direction perpendicular to the sheet feed direction to position and guide the sheet side edges in parallel with the sheet feed direction. The pair of side guides 34*a*, 34*b* may be slidable, such that the distance therebetween is widened or narrowed. Racks (not shown) connected to the bottoms of the pair of side guides 34*a*, 34*b*, respectively, may be engaged with a pinion gear located at a center line of the width (in a direction perpendicular to the sheet feed direction) of the bottom plate of first sheet cassette 1. Thus, the sheets P are centered in first sheet cassette 3, that is, the widthwise center line of the sheets P corresponds with the widthwise center line of first sheet cassettes P. At least one of the side guides 34*a* may be provided with a handle 38 (FIGS. 4 and 5) that is engaged with and held at a rack-shaped engaging portion 37 (FIGS. 8A and 8B) formed on an upper surface of first sheet cassette 3.

Second sheet cassette 30 may be connected to first sheet cassette 3 and may be movable back and forth along the sheet feed direction and pivotable upward at its upstream end as seen in the sheet feed direction. More specifically, as shown in FIGS. 4 and 5, guide holes 35 elongated in the sheet feed direction may be formed in the right and left side plates 3*c* of first sheet cassette 3 that extend in parallel with the sheet feed direction. Round shafts 36 projecting integrally from both sides of a downstream portion (for example, bottom plate 30*a*) of second sheet cassette 30 may be fitted into the respective guide holes 35, such that round shafts 36 are movable in the sheet feed direction and second sheet cassette 30 is pivotable about round shafts 36. The diameter of each of guide holes 35 may be formed, at its downstream end 35*a* as seen in the sheet feed direction, to be relatively large and upwardly inclined. Accordingly, by inclining round shafts 36 with respect to the Y-axis direction, round shafts 36 readily may be inserted into guide holes 35.

Figure 6A:
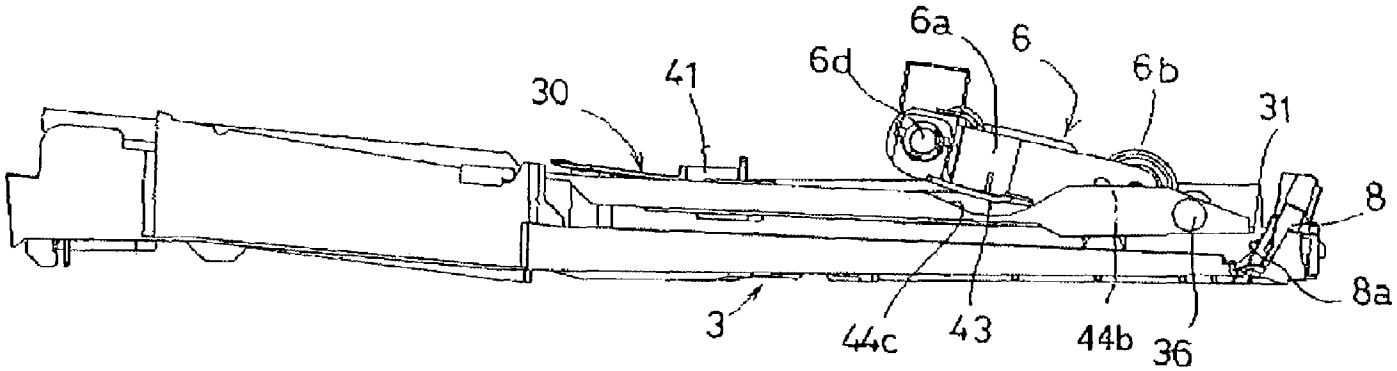
FIG. 6A is a side view of a cam follower of a sheet feeder and a cam of the second sheet cassette in a state shown in FIG. 4.
Figure 6B:
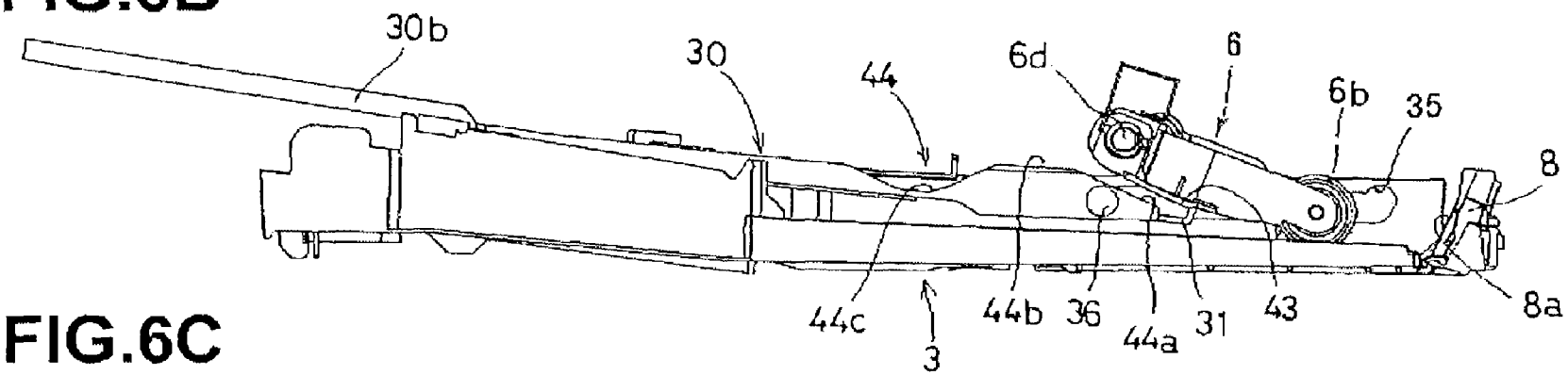
FIG. 6B is a side view of the cam follower of the sheet feeder and the cam of the second sheet cassette in a state shown in FIG. 5.
Figure 6C:
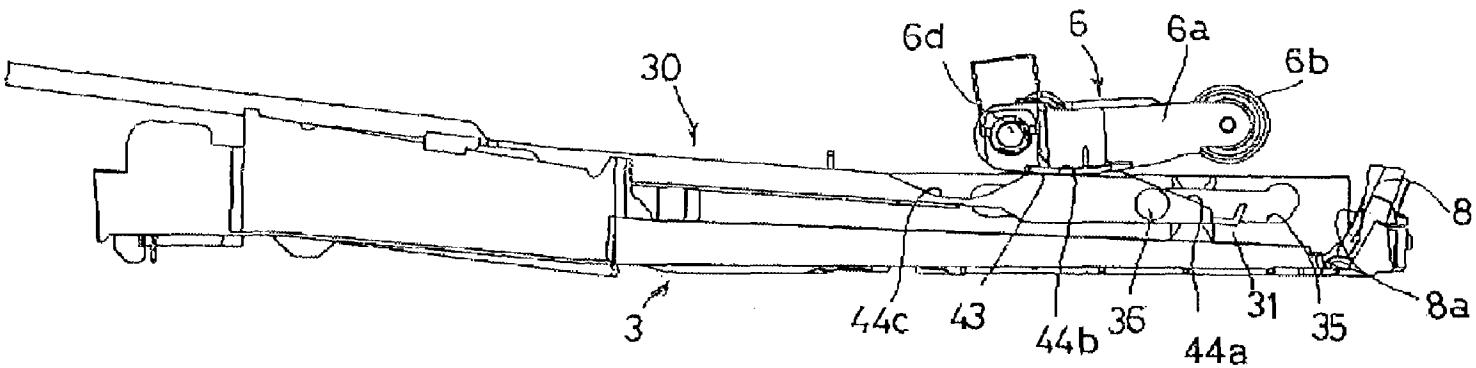
FIG. 6C is a side view of the cam follower of the sheet feeder and the cam of the second sheet cassette when the second sheet cassette is between the sheet feed position and the non-sheet-feed position.
Figure 10:
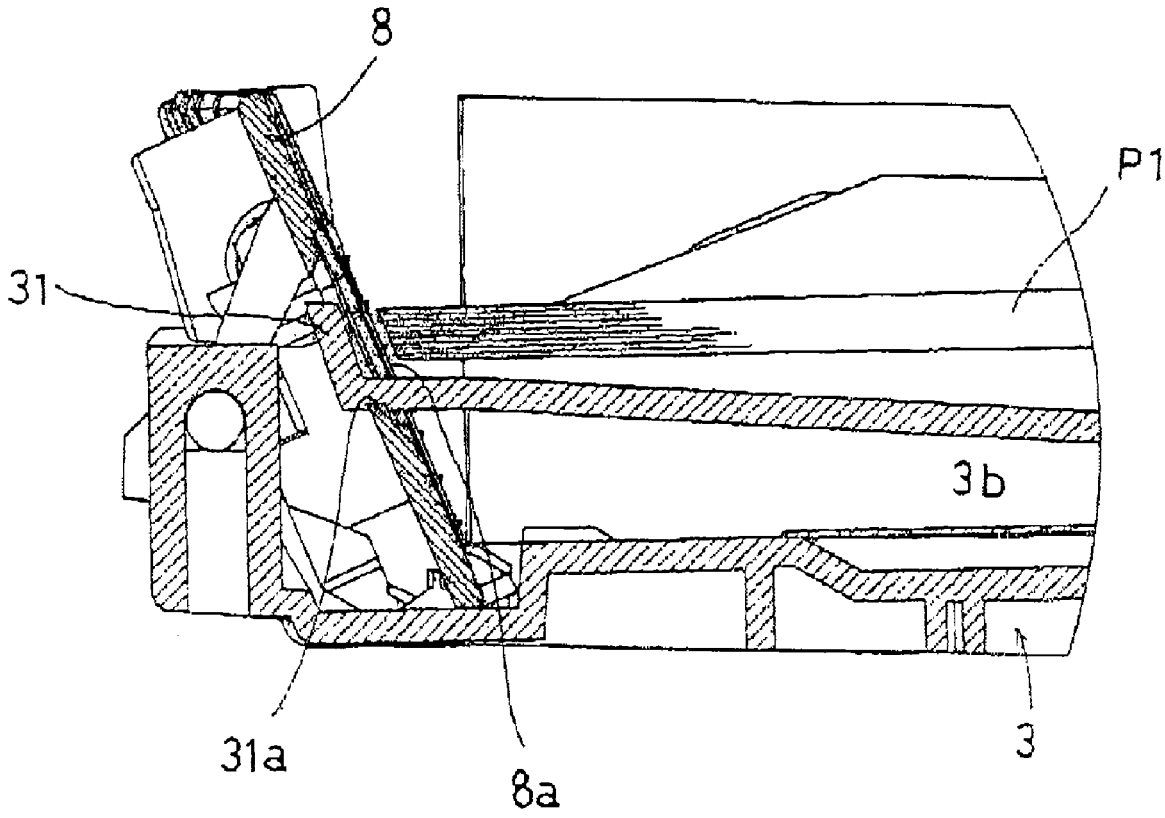
FIG. 10 is a sectional view of the inclined separation plate taken along line X-X of FIG. 8A.
Figure 11:
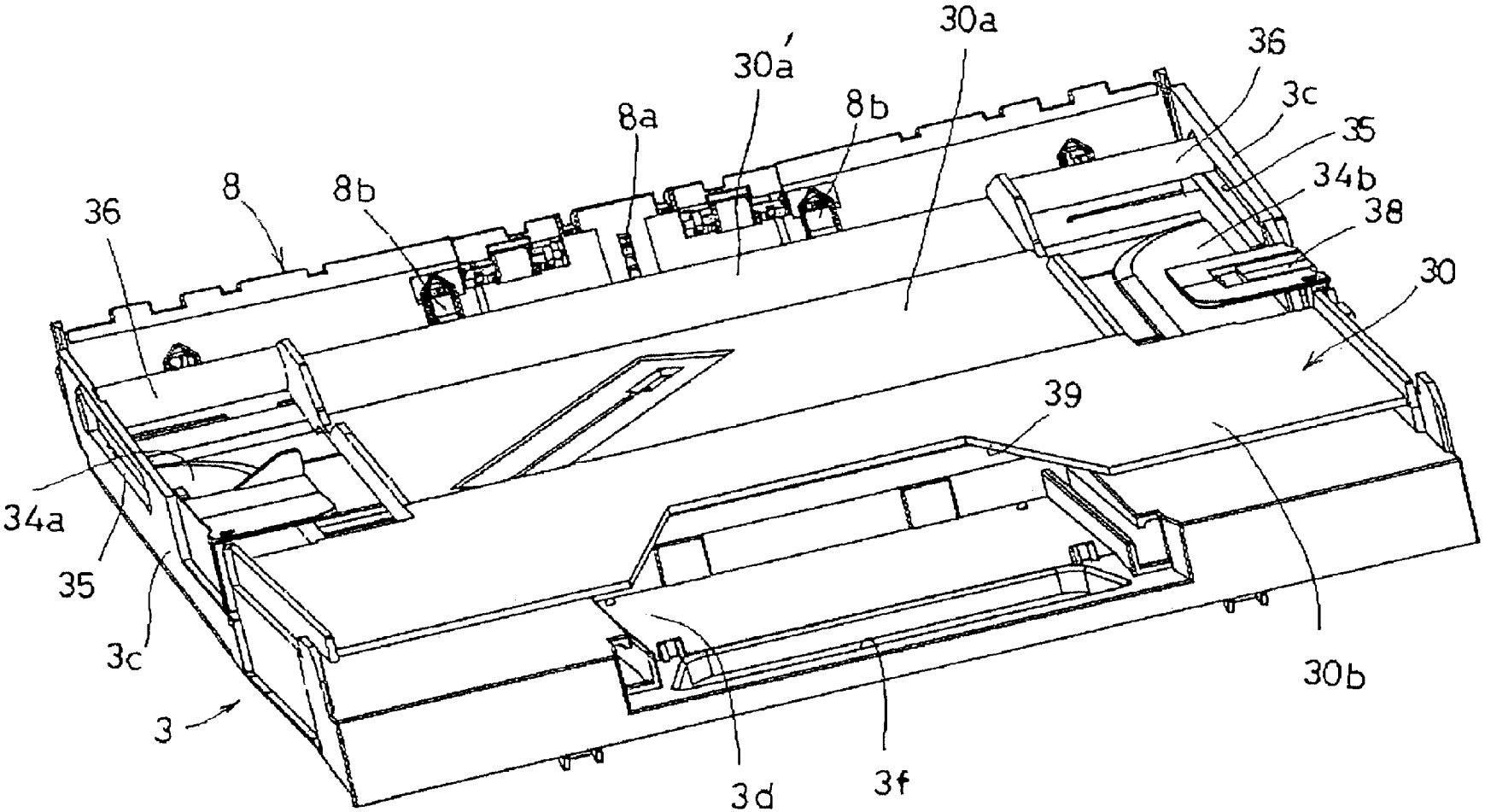
FIG. 11 is a perspective view of an inclined separation plate of the first sheet cassette.

As shown in FIGS. 5, 6A, and 6C, a pair of engaging pieces 31, which may have an upwardly hooked shape, may be formed at a downstream end of bottom plate (holding portion) 30*a* provided on the downstream side of second sheet cassette 30 as seen in the sheet feed direction. When second sheet cassette 30 is pushed to the sheet feed position, the pair of engaging pieces 31 respectively engage a pair of positioning holes 8*b* (FIGS. 10 and 11) formed in main inclined separation panel 8 of first sheet cassette 3. As shown in FIG. 10, engaging piece 31 engages, at a recess 31*a* formed in its lower surface, a lower edge of positioning hole 8*b*, thereby holding second sheet cassette 3 in a state pushed to the sheet feed position not to be displaced in vertical and widthwise directions. Engaging pieces 31 and positioning holes 8*b* may be provided on both sides of elastic separation pad 8*a* at appropriate intervals in the longitudinal direction of main inclined separation panel 8, that is, in the sheet width direction. Thus, when second sheet cassette 30 is set at the sheet feed position with respect to first sheet cassette 3, second sheet cassette 30 may be prevented from being displaced in the vertical direction or in the sheet width direction and from being inclined with respect to the vertical direction. Second sheet cassette 30 may be kept at the sheet feed position to be parallel with the vertical direction and the sheet feed direction, and thus, separation and feeding of the sheets P1 is performed reliably in a stable manner.

On a bottom plate (holding portion) 30*a*, smaller sheets P than those sheets stacked in first sheet cassette 3, such as postcards and L-sized photograph paper, may be stacked. Moreover, not only may sheets having a different size be employed, but also sheets of a different type than those sheets stacked in the first sheet cassette 3 may be employed. For example, sheets exclusively for inkjet printing and calendared sheets for photograph quality printing may be stacked on the bottom plate (holding portion) 30*a*.

Figure 7:
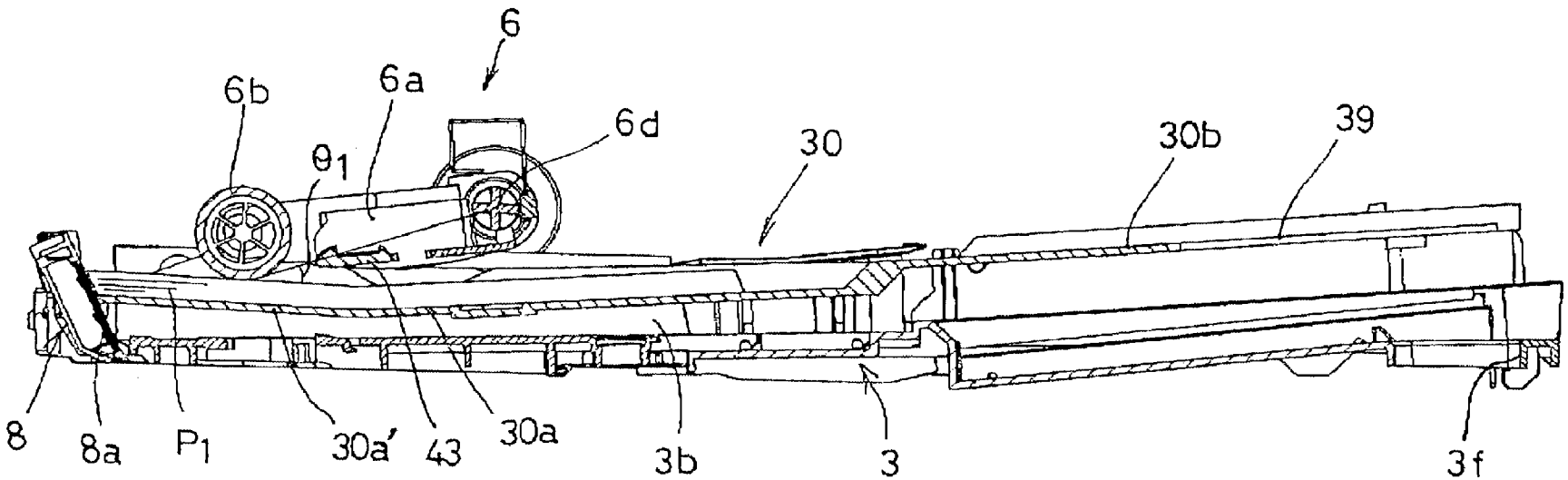
FIG. 7 is a cross-sectional view of the sheet feed device taken along line VII-VII of FIG. 4.

As shown in FIG. 7, a downstream end portion 30*a*' of bottom plate 30*a*, as seen in the sheet feed direction, may be formed to incline upward toward main inclined separation plate 8. That is, downstream end portion 30*a*' may increase in height, e.g., gradually may increase in height, in a direction toward main inclined separation plate 8. The sheets P1 are held on bottom plate 30*a* substantially horizontally, but the sheets P1 conform to an inclined surface of the downstream end portion 30*a*'. The uppermost surface of the sheets P1 stacked on downstream end portion 30*a*' of bottom plate 30*a* forms an angle θ1 with a line between the pivot center of sheet feed arm 6*a* (axial center of drive shaft 6*d*) and a point where sheet feed roller 6*b* contacts the uppermost surface of the sheets P1. The angle θ1 is greater when downstream end portion 30*a*' inclines upward toward main inclined separation plate 8 than when bottom plate 30*a* is horizontal or is substantially horizontal. Accordingly, a force greater than a predetermined value may be applied by sheet feed roller 6*b* to the uppermost surface of the sheets P1, and the sheets P1 in second sheet cassette 30 readily may be fed.

The width W2 of bottom plate 30*a* may be smaller than the width W1 of first sheet cassette 3, and bottom plate 30*a* may be placed at a central portion in the width direction of first sheet cassette 3. Cutouts 70 may be provided in bottom plate 30*a*, such that one end of bottom plate 30*a* is narrower in width. This structure allows the user to readily access handle 38 of side guide 34*b* without removing second sheet cassette 30, and facilitates widthwise positioning of the sheets P in first sheet cassette 3. Sheet receiver 30*b* may be formed integrally with bottom plate 30*a* and may have a continuously wide width from bottom plate 30*a*, which is substantially equal to width of the first sheet cassette 30. As shown in FIGS. 4, 5, 8A, and 8B, sheet receiver 30*b* may be formed with a cutout 39 open toward the front of image recording apparatus 1 to facilitate allowing the user to pinch the edge of the sheet P (P1) with their fingers.

Right and left side plates 30*c* of second sheet cassette 30 may be formed integrally with bottom plate 30*a* to extend along the sheet feed direction. A guide unit for positioning the sheets P1 to be parallel with the sheet feed direction may be provided in an intermediate portion on an upper surface of bottom plate 30*a*. As shown in FIGS. 4, 5, 8A, and 8B, the guide unit comprises a slant guide 41 that contacts a rear corner of each sheet P1 and one of side plates 30*c*, as a fixed side guide that guides a side edge of each sheet P1. Slant guide 41 comprises a rear plate 41*a* that contacts the trailing edge of each sheet P1 placed with its one side edge in contact with the one of side plates 30*c*, and a side plate 41*b* that extends in parallel with side plates 30*c* and contacts the other side edge of each sheet P1. Slant guide 41 may be fitted into a guide groove 42 formed slantingly in the bottom plate 30*a*, so as to be movable along guide groove 42.

As shown in FIG. 8A, the slanting degree of guide groove 42 is set such that when the sheet P1 is an L-sized sheet, the sheet P1 contacts at its trailing edge with rear plate 41*a*, and at the same time, at its side edge with side plate 41*b*. When the sheet P1 is a postcard, which is different in the ratio of a longer side and a shorter side from an L-sized sheet, as shown in FIG. 8B, the sheet P1 contacts either at its trailing edge with rear plate 41*a* or at its side edge with side plate 41*b*. The slanting degree of guide groove 42 may be set differently from in FIGS. 8A and 8B, such that when the sheet P1 is a postcard, the sheet P1 contacts at its trailing edge with rear plate 41*a*, and at the same time, at its side edge with side plate 41*b*. In FIGS. 8A and 8B, side guides 34*a*, 34*b* of first sheet cassette 3 are omitted.

When the auxiliary support member 3*a* of first sheet cassette 3 is accommodated in accommodating portion 3*b* and second sheet cassette 30 is pushed to the downstream end of first sheet cassette 3 as seen in the sheet feed direction, the length in the X-axis direction of first sheet cassette 3 and second sheet cassette 30 is substantially equal to the length in the X-axis direction of image reading device 12 and operation panel 14. Image recording apparatus 1 may be a substantially rectangular parallelepiped shape and may be substantially square as seen in plan view. Thus, image recording apparatus 1 easily may be packed for shipment, and a packing box including image recording apparatus 1 may be compact.

First sheet cassette 3 and second sheet cassette 30 may be inserted into and removed from a bottom portion of housing 2 unitarily in a state where second sheet cassette 30 is pushed into the downstream end of first sheet cassette 3 as seen in the sheet feed direction. Upon insertion and removal of first sheet cassette 3 and second sheet cassette 3, sheet feed arm 6*a* may be moved up and down automatically. After sheet feed roller 6*b* at the end of sheet feed arm 6*a* passes over main inclined separation plate 8, sheet feed roller 6*b* moves down to contact the uppermost one of the sheets P1 in second sheet cassette 30. Such a structure will now be described in detail.

As shown in FIGS. 4, 5, 6A, 6B, and 6C, cam follower 43 shaped like a flat plate projects integrally from sheet feed arm 6*a* of a synthetic resin in a direction parallel with drive shaft 6 and extends over an auxiliary cam 44 formed on an upper surface of one of side plates 30*c* of second sheet cassette 30.

Auxiliary cam 44 comprises a first guide 44*a* that is inclined so as to be lower on the most downstream side of second sheet cassette 30 as seen in the sheet feed direction and gradually higher toward the upstream side thereof, a second guide 44*b* connected to first guide 44*a* and having a substantially uniform height, and a third guide 44*c* connected to second guide 44*b* and recessed into a substantially V shape.

When first cassette 3 and second sheet cassette 30 are inserted unitarily from opening 2*a* at the front of housing 2, and cam follower 43 contacts at its lower surface with first guide 44*a* of auxiliary cam 44 provided on a side closer to main inclined separation plate 8, cam follower 43 may be raised as second sheet cassette 30 is moved forth (inward), and sheet feed arm 6*a* and sheet feed roller 6*a* may be pivoted upward together with cam follower 43, and sheet feed roller 6*b* and sheet feed arm 6*a* pass over main inclined separation panel 8.

When sheet feed arm 6*a* and sheet feed roller 6*b* are raised by cam follower 43 in contact with second guide 44*b*, sheet feed arm 6*a* and sheet feed roller 6*b* may retract through an opening 21*c* provided in bottom plate 21*b* of main frame 21 into a space within main frame 21. At this time, cam follower 43 may come in contact with or may be drawn closer to a lower surface of bottom plate 21*b*. This structure allows sheet feed arm 6*a* and sheet feed roller 6*b* to pivot vertically without increasing the height of a space defined between bottom plate 21*b* and second sheet cassette 30. Accordingly, the height between first sheet cassette 3 and bottom plate 21*b* of the main frame 21 may be reduced, and image recording apparatus 1 may be relatively short in overall height.

When cam follower 43 reaches a descending portion of third guide 44*c* after passing over second guide 44*b*, sheet feed arm 6*a*, which is urged downward, and sheet feed roller 6*b* may be pivoted downward. Then, as shown in FIG. 6A, sheet feed roller 6*b* may come into contact with the uppermost one of the sheets P1 stacked on bottom plate 30*a*.

When second sheet cassette 30 is moved back (outward) in a state where first sheet cassette 3 is set at a fully pushed position (sheet feed position) in housing 2, cam follower 43 slides over third guide 44*c*, second guide 44*b* (FIG. 6C), and first guide 44*a* in this order, and finally comes off side plate 30*c* of second sheet cassette 3. As shown in FIG. 6B, when second sheet cassette 3 is at a position moved back from sheet feed roller 6*b* (at a non-sheet-feed position), sheet feed roller 6*b* is allowed to contact the bottom (the uppermost one of the sheets P) of first sheet cassette 3 and perform sheet feed operation. On the other hand, when second sheet cassette 30 is moved forth to the sheet feed poison from the non-sheet-feed position in a state where first sheet cassette 3 is set at the sheet feed position in housing 2, cam follower 43 slides over first guide 44*a*, second guide 44*b* (FIG. 6C), and third guide 44*c* in this order, and sheet feed roller 6*b* is allowed to contact the uppermost one of the sheets P1 in second sheet cassette 30.

As described above, cam follower 43 provided at sheet feeder 6 cooperates with auxiliary cam 44 provided at second sheet cassette 30 to vertically pivot sheet feed roller 6*a* temporarily as second sheet cassette 30 is moved back and forth on first sheet cassette 3 in housing 2. Also, by the cooperation between cam follower 43 and auxiliary cam 44, sheet feed roller 6*a* is moved up and down automatically not to collide with main inclined separation plate 8 when first sheet cassette 3 is inserted to and removed from housing 2 unitarily with second sheet cassette 30 that is fully pushed into first sheet cassette 3. Thus, handling of first sheet cassette 3 and second sheet cassette 30 is made easy.

When second sheet cassette 30 stacked with smaller-sized sheets P1 is pushed to the sheet feed position near the downstream end of first sheet cassette 3 as seen in the sheet feed direction, in a state where larger-sized sheets P are stacked in first sheet cassettes 3, sheet feed roller 6*b* is allowed to press the uppermost one of the sheets P1 in second sheet cassette 30. Thus, image recording operation can be carried out in this state. On the other hand, when second sheet cassette 30 stacked with smaller-sized sheets P1 is pulled back to a position where round shafts 36 reach the upstream ends of guide holes 35 as seen in the sheet feed direction, second sheet cassette 3 is not detached from first sheet cassette 3, and the sheets P1 are prevented from getting out of position by slant guide 41. In this case, image recording operation can be carried out immediately by feeding the sheets P in first sheet cassette 3 with sheet feed roller 6*b*. Because elastic separation pad 8*a* of main inclined separation plate 8 is located within the width of bottom plate 30*a* of second sheet cassette 30, a single sheet feed roller 6*b* and a single separation plate 8 can be commonly used for separation and feeding of the sheets P (P1) stacked in first sheet cassette 3 and second sheet cassette 30.

First sheet cassette 3 may be replenished with sheets P by lifting the upstream end of the second sheet cassette 30 in a state where second sheet cassette 30 is pushed with respect to first sheet cassette 3 (to the sheet feed position), or by lifting the upstream end of second sheet cassette 30 in a state where second sheet cassette 30 is pulled back with respect to first sheet cassette 3 (to the non-sheet-feed position). In either case, second sheet cassette 30 may be pivoted upward about round shafts 36 to provide a larger vertical space at the upstream end of first sheet cassette 3, thereby facilitating loading sheets P in first sheet cassette 3.

Accommodating portion 3*b* of first sheet cassette 3 may be inclined downward toward main inclined separation plate 8, that is, toward the sheet feed direction, and accommodating portion 3*b* may open outward through opening 3*a* of housing 2. Sheet feed arm 6*a* of sheet feeder 6 may be configured to move tiltably. Thus, the sheets P stacked in accommodating portion 3*b* of first sheet cassette 3 are not displaced toward the upstream side as seen in the sheet feed direction, and an additional guide member to contact the trailing edges of the sheets P is not needed. Sheets P can be loaded to first sheet cassette 3 from its upstream side without lifting the upstream end of second sheet cassette 30.

Sheet receiver 30*b* may be formed continuously from bottom plate (holding portion) 30*a* of second sheet cassette 30. When image recording is performed with second sheet cassette 30 set at the sheet feed position, smaller-sized sheets P1 in second sheet cassette 30 are fed to recording unit 7, and the sheets P1 recorded thereon are received by sheet receiver 30*b* without being mixed with the blank sheets P1. Also, when image recording is performed for larger-sized sheets P, the sheets P recorded thereon are received by sheet receiver 30*b* of second sheet cassette 30 pulled back to the non-sheet-feed position, reliably without projecting from sheet receiver 30*b*.

Figure 9:
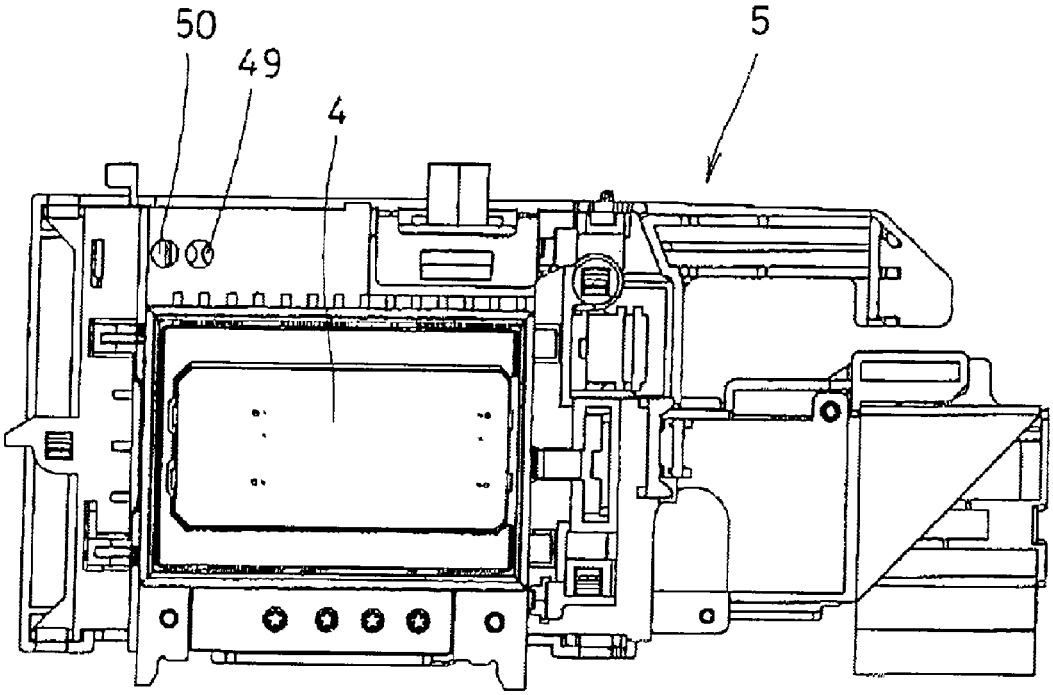
FIG. 9 is a bottom view of a carriage showing sensors.

As shown in FIG. 9, image recording apparatus 1 may comprise a media sensor 49 and a cassette sensor 50 that are provided on an underside of carriage 5. Media sensor 49 detects the width of the sheet P (P1) fed to the recording unit 7, and cassette sensor 50 detects whether second sheet cassette 30 is set at the sheet feed position. A non-contact type photosensitive sensor, such as an infrared sensor, may be used for both media sensor 49 and cassette sensor 50. A detection hole (not shown) may be provided in the platen intermediate in the Y-axis direction, so that cassette sensor 50 can detect bottom plate 30*a* through the detection hole only when second sheet cassette 30 is set at the sheet feed position. When carriage 5 moves in the Y-axis direction, media sensor 49 detects the width of the leading edge of the sheet P (P1) that is stopped temporarily after being fed a little bit further from register rollers 27. When the user commands image recording apparatus 1 to start image recording by designating the desired type or size of a sheet to be used, and cassette sensor 50 determines from a detected value that second sheet cassette 30 stacked with the designated sheets is not set at (pushed to) the sheet feed position, sheet feed may be prohibited and an error message may be reported to the user. Sheet feed is not permitted until the user sets second sheet cassette 30 at the sheet feed position. Similarly, when first sheet cassette 3 is stacked with the designated sheets, but second sheet cassette 30 stacked with the sheets different from the desired sheets is set at the sheet feed position, sheet feed is prohibited and an error message may be reported to the user. Sheet feed is not permitted until the user sets second sheet cassette 30 at the non-sheet-feed position.

When the carriage 5 moves in the Y-axis direction, media sensor 49 detects the width of the leading edge of the sheet P (P1) that is stopped temporarily after being fed a little bit further from register rollers 27, and an electronic control device (not shown) determines the size of the sheet P (P1) from a detected value. When the size determined does not match the type or size designated by the user, image recording on the fed sheet P (P1) is prohibited and the blank sheet P (P1) is discharged to sheet discharge portion 10. Thus, the user does not waste sheets. The setting position of the sheet P (P1) in the Y-axis direction also may be detected by media sensor 49.

Figure 12:
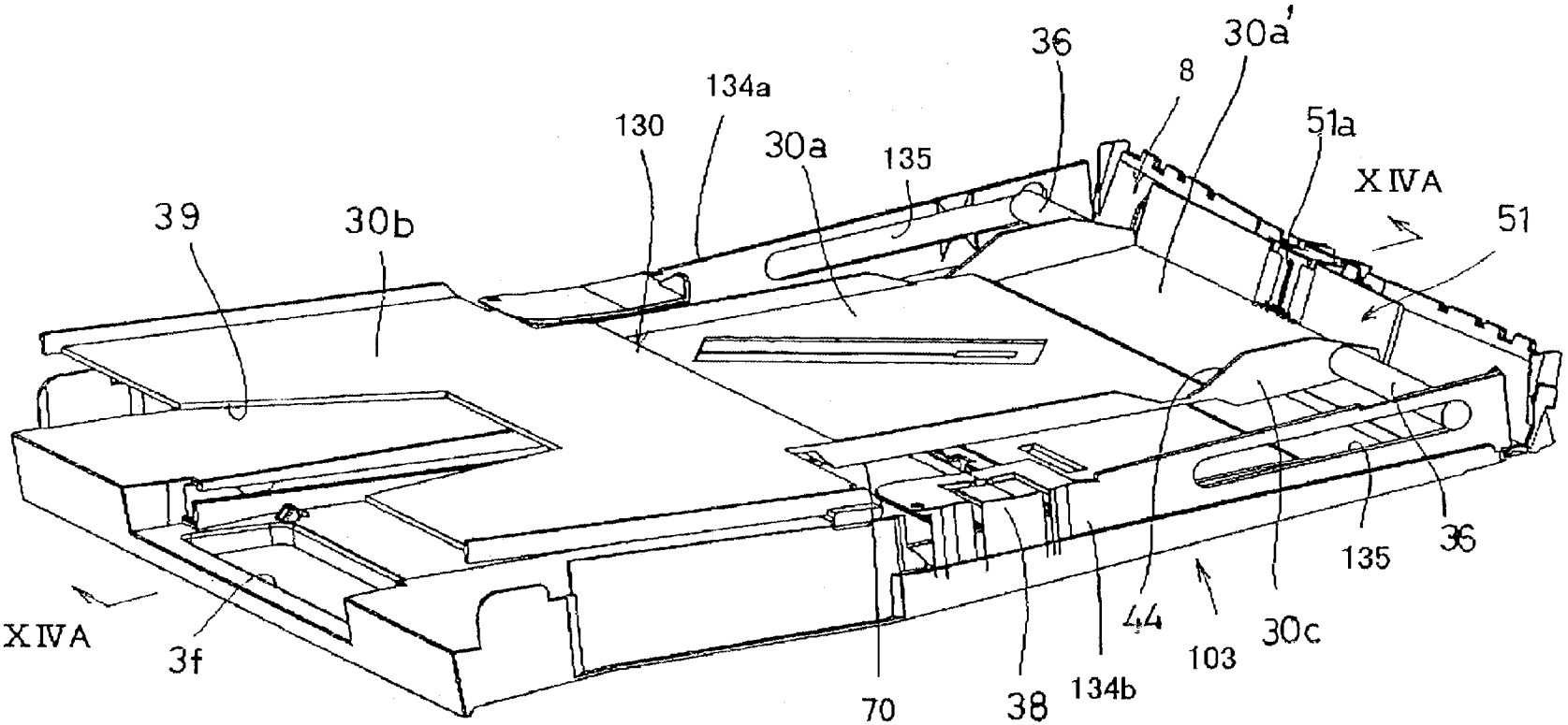
FIG. 12 is a perspective view of modified first and second sheet feed cassettes where the second sheet feed cassette having an auxiliary inclined separation plate is set at the sheet feed position on the first sheet cassette.
Figure 13:
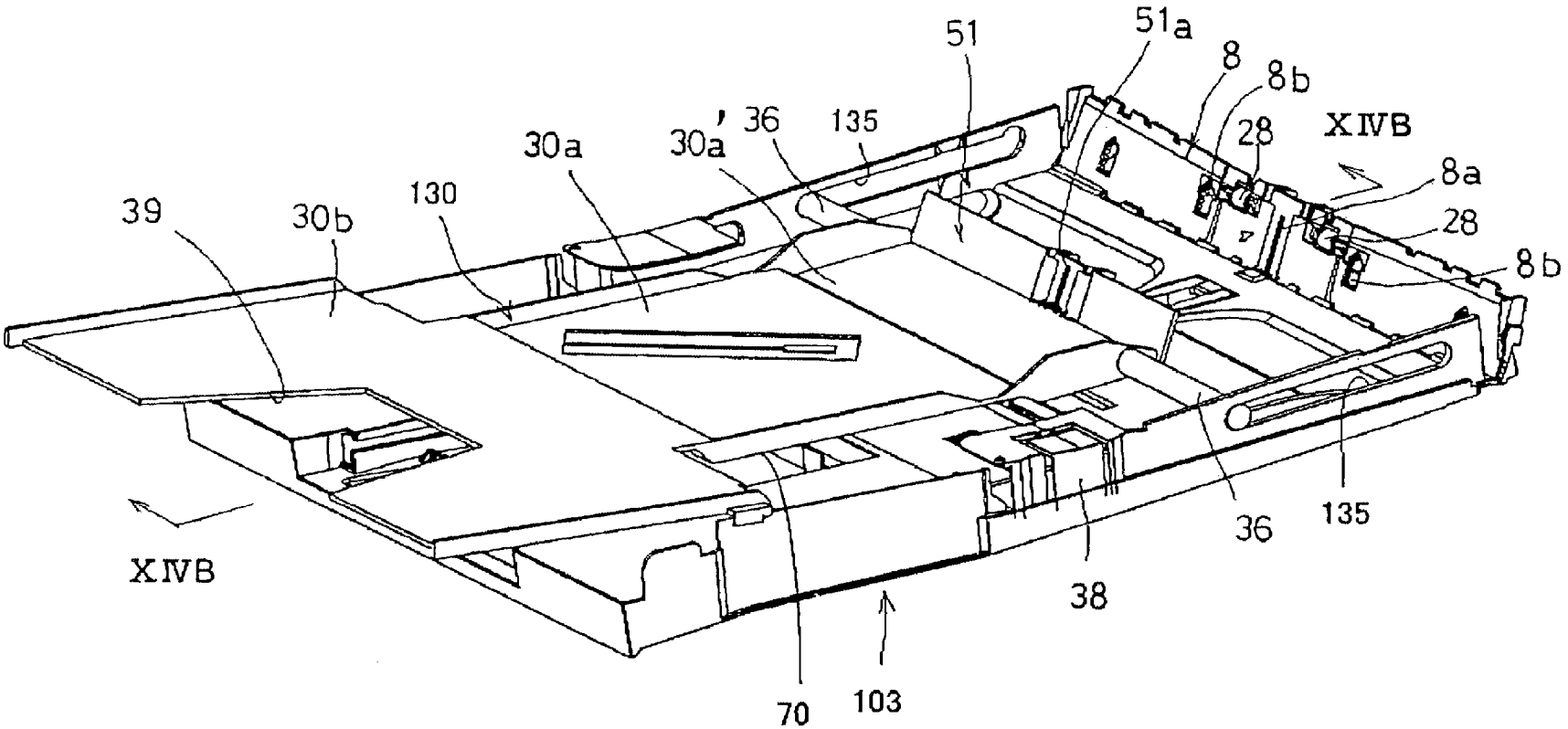
FIG. 13 is a perspective view of the modified first and second sheet feed cassettes, where the second sheet cassette is moved back to the non-sheet-feed position on the first sheet cassette.

FIGS. 12, 13, 14A, and 14B show a modification of first sheet cassette 3 and second sheet cassette 30 of the first embodiment of the present invention. A second sheet cassette 130 may comprise an auxiliary inclined separation plate 51 at a downstream end of a bottom plate 30*a* as seen in the sheet feed direction. Auxiliary inclined separation plate 51 may be provided with an elastic separation pad 51*a* that is similar to elastic separation pad 8*a* provided for main inclined separation panel 8. As shown in FIGS. 12 and 13, guide holes 135 for connecting second sheet cassette 130 via round shafts 36 to first sheet cassette 103 may be formed in side guides 134*a*, 134*b* of first sheet cassette 103.

Figure 14A:
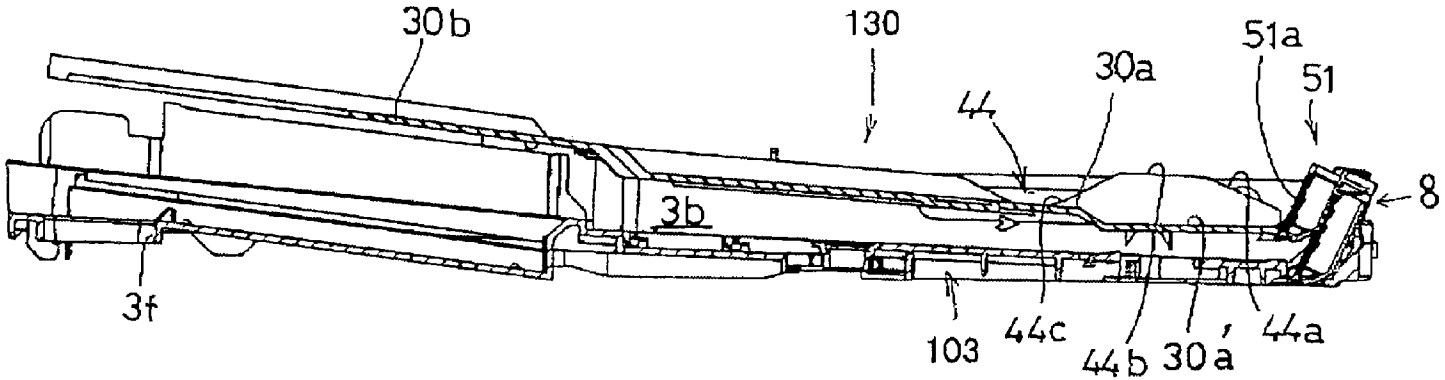
FIG. 14A is a cross-sectional view of the first sheet cassette and the second sheet cassette taken along line XIVA-XIVA of FIG. 12.
Figure 14B:
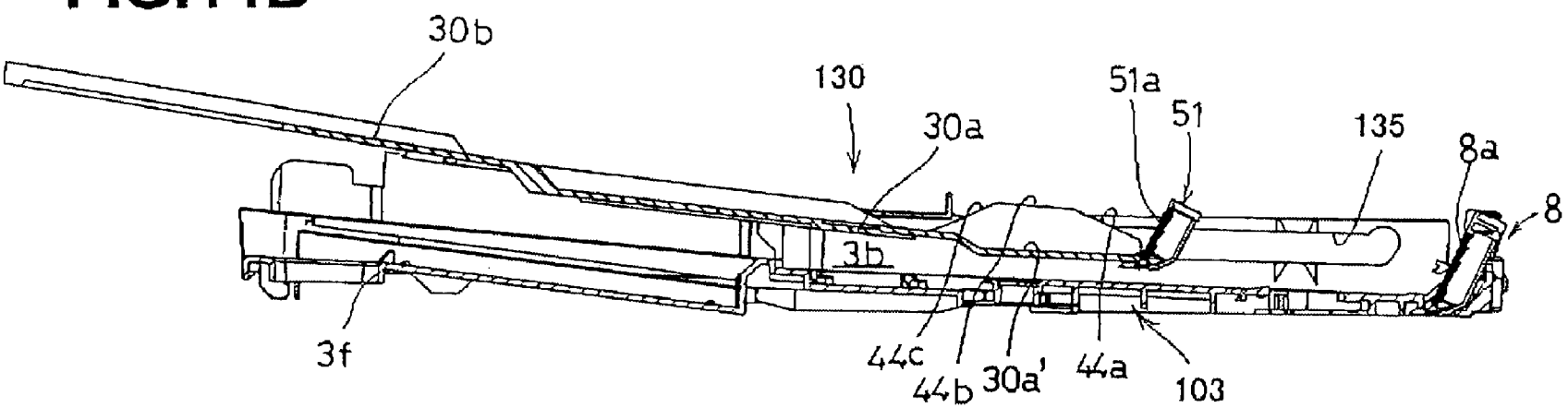
FIG. 14B is a cross-sectional view of the first sheet cassette and the second sheet cassette taken along line XIVB-XIVB of FIG. 13.

As shown in FIGS. 12 and 14A, when second sheet cassette 130 is pushed with respect to the first sheet cassette 103 and set at the sheet feed position, auxiliary inclined separation plate 51 is located adjacent to an inner surface of main inclined separation plate 8. Sheets P1 in second sheet cassette 130 are fed by rotation of a sheet feed roller 6*b* and separated one by one at elastic separation pad 51*a* of auxiliary inclined separation plate 51. A downstream end portion 30*a*' of bottom plate (holding portion) 30*a* of second sheet cassette 130 may be formed to incline upward, toward auxiliary inclined separation plate 51. That is, downstream end portion 30*a*' may increase in height, e.g., gradually may increase in height, in a direction toward auxiliary inclined separation plate 51. The sheets P1 are held on bottom plate 30*a* substantially horizontally, but the sheets P1 conform to an inclined surface of the downstream end portion 30*a*'. Thus, a force greater than a predetermined value may be applied by sheet feed roller 6*b* to the uppermost surface of the sheets P1, thereby providing reliable sheet feeding.

The sheets P1 stacked on bottom panel 30*a* are close at their leading edges to the auxiliary inclined separation plate 51. When second sheet cassette 130 is moved back and forth, auxiliary inclined separation plate 51 cooperates with guide unit 41 to keep the sheets P1 in position. Accordingly, switching between first sheet cassette 103 and second sheet cassette 130 may be performed smoothly.

FIGS. 15-20 show a sheet feed device 101 according to a second embodiment of the present invention. In this embodiment, a first sheet feeder 206 for a first sheet cassette 203 and a second sheet feeder 60 for a second sheet cassette 230 may be disposed side by side, and first sheet feeder 206 and second sheet feeder 60 may be configured to be raised or lowered selectively. When sheets P in first sheet cassette 203 are fed, a sheet feed roller 6*b* of first sheet feeder 206 contacts the uppermost one of the sheets P in an accommodating portion 3*b* of first sheet cassette 203, and a sheet feed roller 60*b* of second sheet feeder 60 is held at a raised position. On the other hand, when sheets P1 in the second sheet cassette 230 are fed, the second sheet feed roller 60*b* of the second sheet feeder 60 contacts the uppermost one of the sheets P1 on a holding portion 30*a* of second sheet cassette 230, and sheet feed roller 6*b* of first sheet feeder 206 is kept at a raised position.

Figure 15:
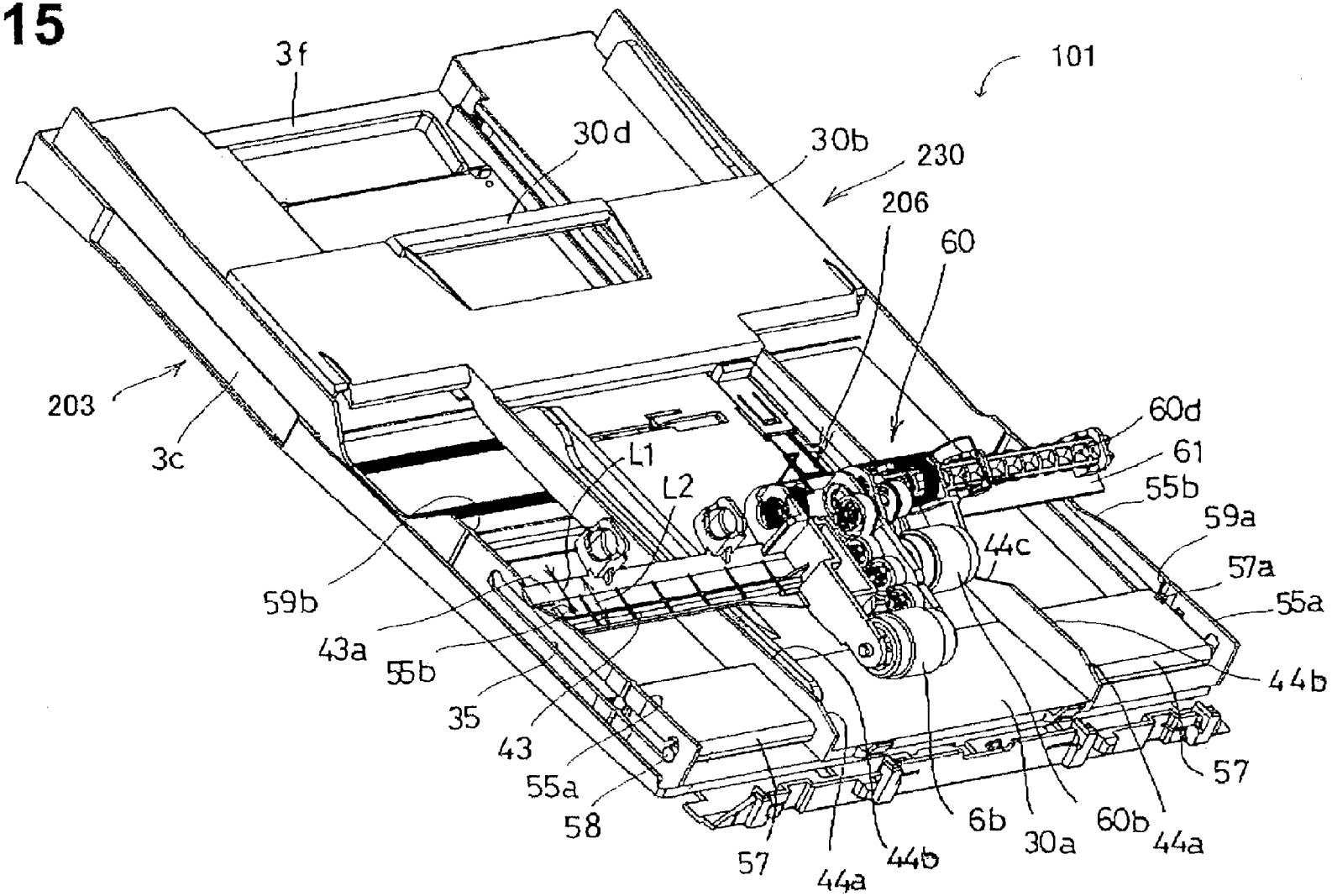
FIG. 15 is perspective view of a sheet feed device according to a second embodiment of the present invention, in which a second sheet cassette is set at a sheet feed position on a first sheet cassette.
Figure 16:
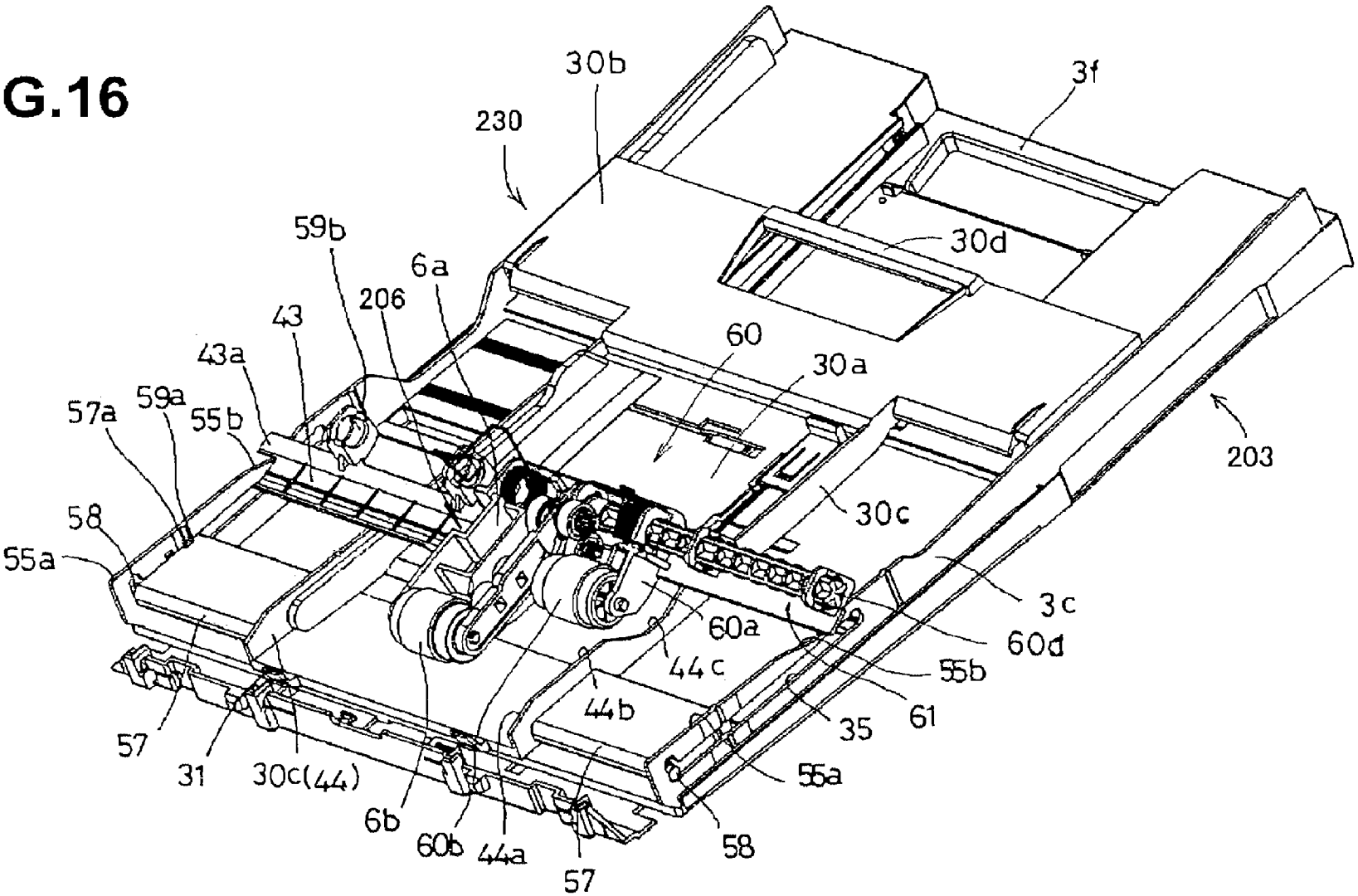
FIG. 16 is a perspective view of the sheet feed device according to the second embodiment of the present invention, as viewed from a different direction from in FIG. 15.
Figure 17:
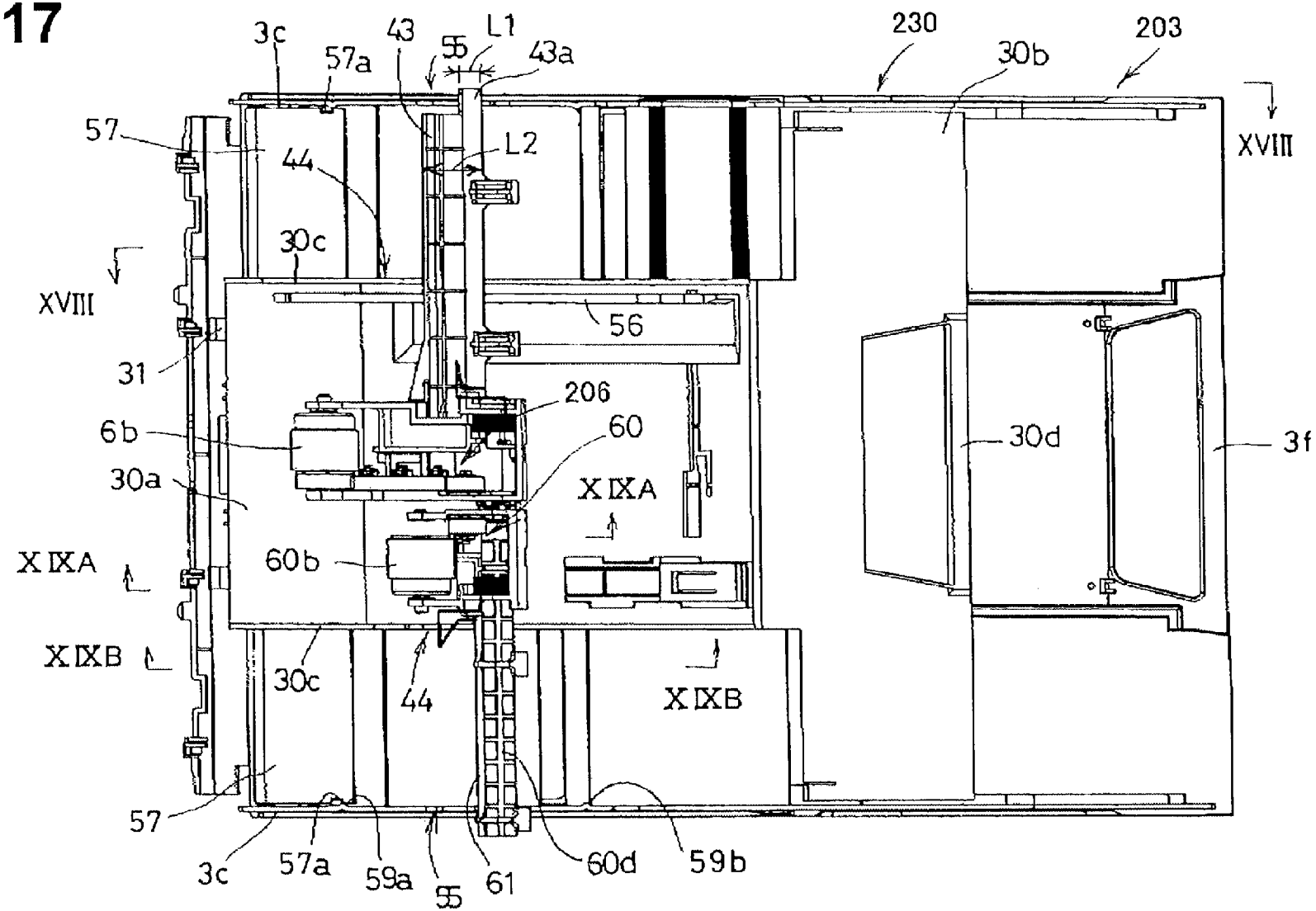
FIG. 17 is a plan view of the sheet feed device according to the second embodiment of the present invention.
Figure 18:
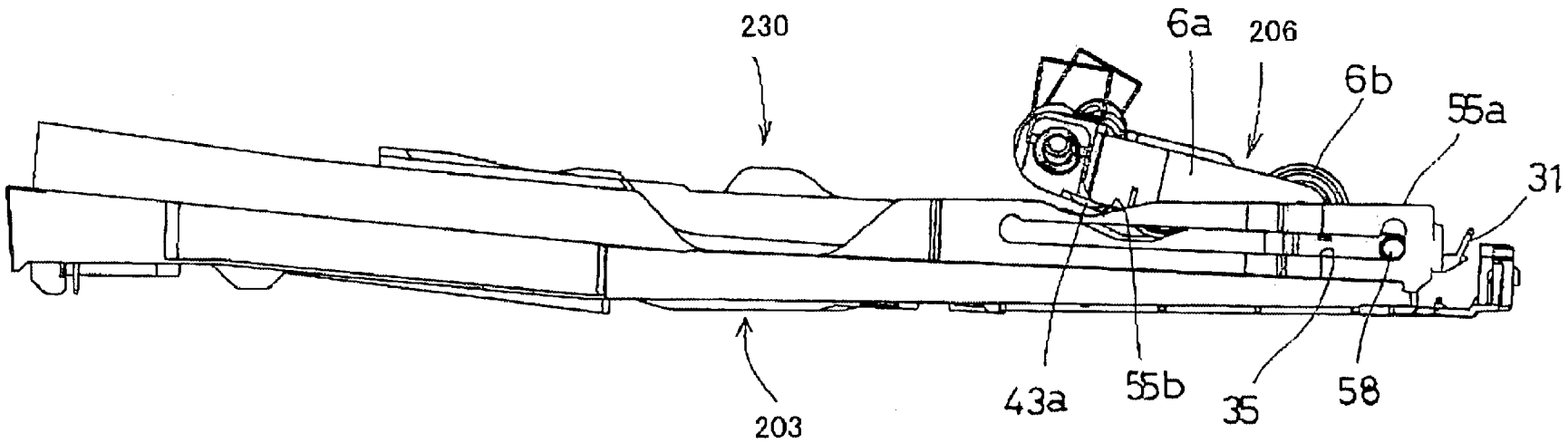
FIG. 18 is a cross-sectional view of the sheet feed device taken along line XVIII-XVIII of FIG. 17.

In FIGS. 15-17, drive shaft 6*d* and main inclined separation plate 8 are omitted.

The inclination angle of sheet feed arm 6*a* with respect to the uppermost surface of the sheets P, that is, an angle formed by the uppermost surface of the sheets P with a line between the pivot center of sheet feed arm 6*a* (axial center of the drive shaft 6*d*) and a point where sheet feed roller 6*b* contacts the uppermost surface of the sheets P is large when the height of the sheets P stacked in first sheet cassette 203 is small. Similarly, the inclination angle of sheet feed arm 60*a* with respect to the uppermost surface of the sheets P1, that is, an angle formed by the uppermost surface of the sheets P1 with a line between the pivot center of sheet feed arm 60*a* (axial center of drive shaft 60*d*) and a point where sheet feed roller 60*b* contacts the uppermost surface of the sheets P1 is large when the height of the sheets P1 stacked in second sheet cassette 230 is small. When the inclination angle of sheet feed arm. 6*a*, 60*a* is large, a force applied by sheet feed arm 6*a*, 60*a* to the sheets P, P1 also is large, and when the inclination angle of sheet feed arm 6*a*, 60*a* is small, a force applied by sheet feed arm 6*a*, 60*a* to the sheets P, P1 also is small.

Figure 20:
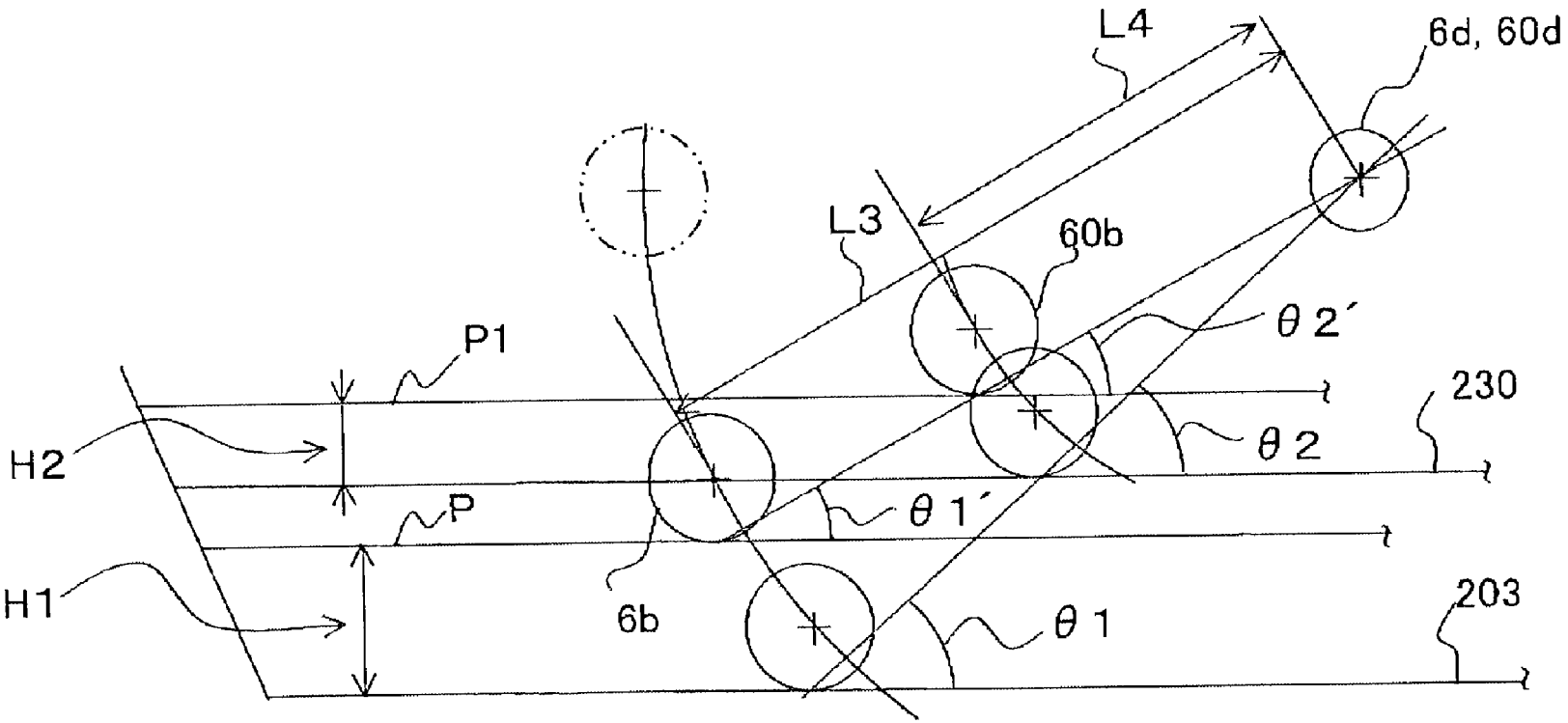
FIG. 20 is a schematic diagram showing the inclination angle of a sheet feed arm of the first sheet feeder and the inclination angle of a sheet feed arm of the second sheet feeder according to the second embodiment of the present invention.

As shown in FIG. 20, sheet feed arm 6*a* forms a maximum inclination angle of θ1 with respect to the uppermost sheet surface when a single sheet P is in the first sheet cassette 203, and forms a minimum inclination angle of θ1' with respect to the uppermost sheet surface when sheets P are loaded to a maximum loading height in the first sheet cassette 203. Similarly, sheet feed arm 60*a* forms a maximum inclination angle of θ2 with respect to the uppermost sheet surface when a single sheet P1 is in the second sheet cassette 230, and forms a minimum inclination angle of θ2' with respect to the uppermost sheet surface when sheets P1 are loaded to a maximum loading height in the second sheet cassette 230.

In this embodiment, the length L4 of sheet feed arm 60*a* of second sheet feeder 60 is selected to be less than the length L3 of sheet feed arm 6*a* of first sheet feeder 206, and the pivot center of sheet feed arm 6*a* (axial center of drive shaft 6*d*) and the pivot center of sheet feed arm 60*a* (axial center of drive shaft 60*d*) are selected to be substantially aligned with each other and to be at substantially the same height. In addition, second sheet cassette 230 is disposed above first sheet cassette 203, and the maximum loading height H1 of first sheet cassette 203 is selected to be greater than the maximum loading height H2 of second sheet cassette 230. For example, 100 sheets of plain paper may be accommodated in first sheet cassette 203, and fifty sheets of plain paper or twenty sheets of photograph paper may be accommodated in second sheet cassette 230. When second sheet cassette 230 is set at the sheet feed position, sheet feed roller 6*b* of first sheet feeder 206 is away from the sheets P1 in second sheet cassette 230 and is held at a position shown by a two-dotted line.

With this structure, the maximum inclination angle θ1 of sheet feed arm 6*a* may be equal to the maximum inclination angle θ2 of sheet feed arm 60*a*, and the minimum inclination angle θ1' of sheet feed arm 6*a* may be equal to the minimum inclination angle θ2' of sheet feed arm 60*a*. Accordingly, a range of the inclination angle of sheet feed arm 6*a* and a range of the inclination angle of sheet feed arm 60*a* may be selected to be substantially equal to each other and within a predetermined range, and thus, misfeeding of sheets when there is a small force applied by sheet feed roller 6*d*, 60*d* to the sheets P, P1, and/or multi-feeding of sheets when there is a large force applied by sheet feed roller 6*d*, 60*d* to the sheets P, P1 may be prevented.

A cam follower 43 shaped like a flat plate may project integrally from a sheet feed arm 6*a* (drive shaft 6*d* is omitted from FIGS. 15-17) and extends toward and over an auxiliary cam 44*b* and a main cam 55. Auxiliary cam 44 may have a uniform height guide 44*b* formed on an upper surface of one of side plates 30*c* of second sheet cassettes 230, and main cam 55 may be formed to have a varying height on an upper surface of one of side plate 3*c* of first sheet cassette 303. An end 43*a* of cam follower 43, which contacts main cam 55, has a length L1 in the sheet-feed direction, while cam follower 43, which contacts auxiliary cam 44, has a length L2. L1 may be smaller than L2, as shown in FIGS. 15 and 17.

Second sheet feeder 60 is the same, in the basic structure, as first sheet feeder 206. A drive shaft 60*d* and cam follower 61 of second sheet feeder 60 are parallel with drive shaft 6*d* of first sheet feeder 206, but extend in the opposite direction to that of drive shaft 6*d*. That is, drive shaft 60*d* and cam follower 61 extend toward and over the side plates 3*c*, 30*c* provided on a side remote from cam follower 43, as shown in FIGS. 15-17.

A main cam 55 to receive cam follower 61 is formed on side plate 3*c* provided on a side remote from cam follower 43. Main cam 55 may comprise a first guide 55*a* having a uniform height from the most downstream side of the first sheet cassette 203 to the upstream side thereof as seen in the sheet feed direction, and a second guide 55*b* connected to first guide 55*a* and shaped like V having a smaller height in the middle.

An auxiliary cam 44 to receive cam follower 61 may comprise a first guide 44*a* that is inclined so as to be lower on the most downstream side of second sheet cassette 230 and gradually higher toward the upstream side thereof as seen in the sheet feed direction, a second guide 44*b* connected to first guide 44*a* and having a substantially uniform height, and a third guide 44*c* connected to second guide 44*b* and recessed into a substantially V shape.

Figure 19A:
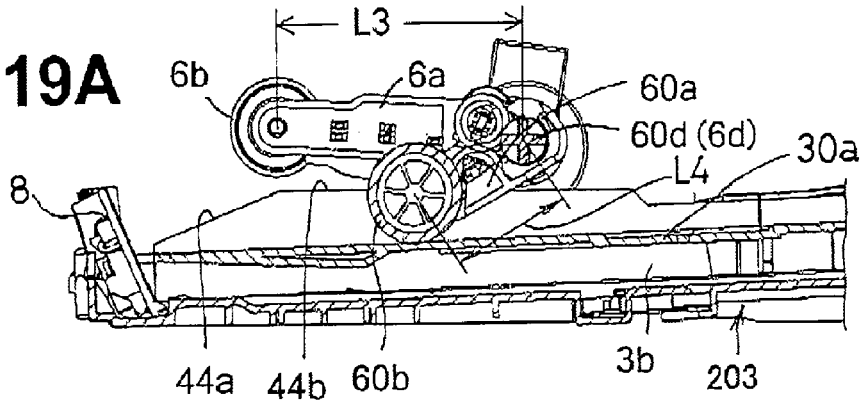
FIG. 19A is a cross-sectional view of the sheet feed device taken along line XIXA-XIXA of FIG. 17.
Figure 19B:
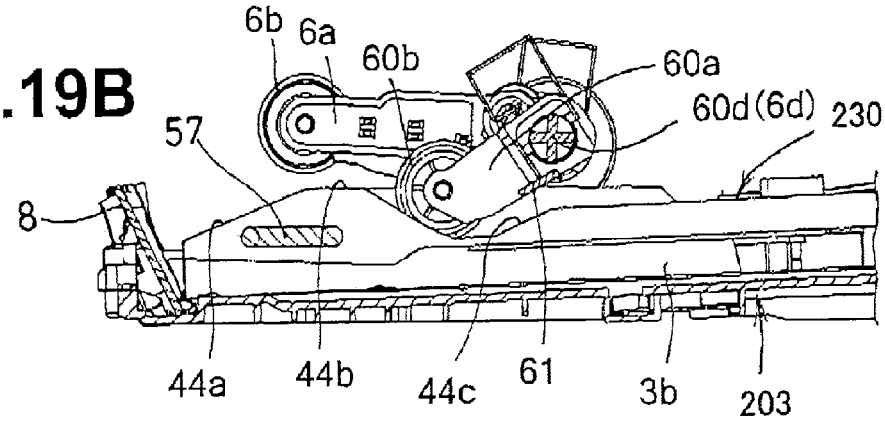
FIG. 19B is a cross-sectional view of the sheet feed device taken along line XIXB-XIXB of FIG. 17.
Figure 19C:
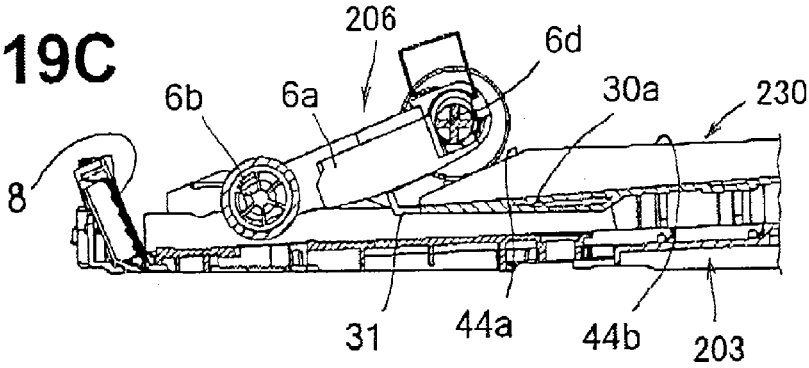
FIG. 19C is a side view of a first sheet feeder according to the second embodiment of the present invention in a state where the second sheet cassette is moved back to a non-sheet-feed position.

In this third embodiment of the present invention, as shown in FIGS. 15-18, when first sheet cassette 203 and second sheet cassette 230 are inserted unitarily into housing 2 in a state where second sheet cassette 230 is pushed to sheet feed position with respect to the first sheet cassette 203, an end 43*a* of cam follower 43 of first sheet feeder 206 contacts an end edge of one side plate 3*c* of first sheet cassette 203 and rides on first guide 55*a*. At this time, sheet feed arm 6*a* is raised to a substantially horizontal orientation, and sheet feed roller 6*b* passes beyond a main inclined separation plate 8. Then, an intermediate portion of cam follower 43 is kept in contact with high horizontal second guide 44*b*, and thereby sheet feed arm 6*a* of first sheet feeder 206 is kept at a substantially horizontal orientation, as shown in FIGS. 19A and 19B.

Meanwhile, when cam follower 61 of second sheet feeder 60 contacts an end edge of the other side plate 3*c* of first sheet cassette 203 and rides on first guide 55*a*, sheet feed arm 60*a* is pivoted upward, and sheet feed roller 60*b* is allowed to pass over main inclined separation plate 8. Then, cam follower 61 contacts first inclined guide 44*a* and horizontal second guide 44*b* of auxiliary cam 44 of the other side plate 3*c*. After that, when cam follower 61 reaches the low, V-shaped third guide 44*c* (and V-shaped second guide 55*b* of first sheet cassette 203), sheet feed arm 60*a* is pivoted downward, and sheet feed roller 60*b* is allowed to contact the uppermost one of the sheets P1 stacked on bottom plate 30*a* of second sheet cassette 430.

Figure 19D:
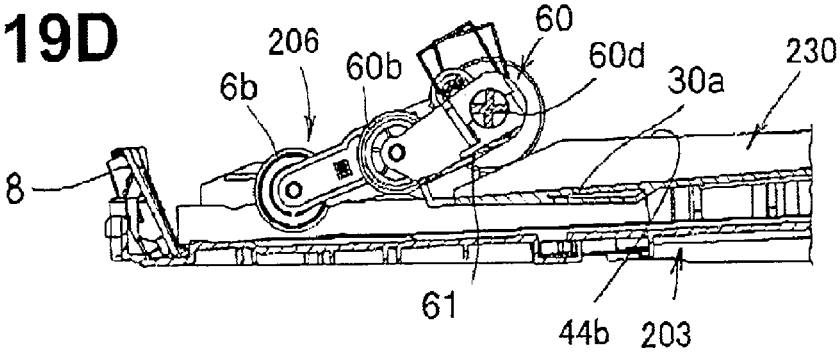
FIG. 19D is a side view of the first sheet feeder and a second sheet feeder according to the second embodiment of the present invention, in a state where the second sheet cassette is moved back to the non-sheet-feed position.

When second sheet cassette 230 is moved to the non-sheet-feed position in a state where first sheet cassette 203 is set at the sheet feed position, cam follower 61 of second sheet feeder 60 is raised along V-shaped third guide 44*c*, and slides on high horizontal second guide 44*b*. After that, cam follower 61 is lowered along first inclined guide 44*a*, and finally comes off auxiliary cam 44. At this time, however, an end of cam follower 61 is in contact with high horizontal first guide 55*a* of first cam 55, and thus sheet feed roller 60*b* is kept at such an orientation that its lower surface is away from the uppermost one of the sheets P in accommodating portion 3*b* of first sheet cassette 203, as shown in FIG. 19D. At this time, sheet feed roller 6*b* of first sheet feeder 206 is allowed to contact the uppermost one of the sheets P in accommodating portion 3*b*.

As describe above, first sheet feeder 206 and second sheet feeder 60 are shifted selectively to an operating position or a non-operating position for sheet feeding as first sheet cassette 20, and second sheet cassette 230 are moved unitarily to and from the sheet feed position and as second sheet cassette 230 is moved on first sheet cassette 203 between the sheet feed position and the non-sheet-feed position. Second sheet cassette 230 may be moved back and forth by gripping a handle 30*d* that is provided at a downstream end of sheet receiver 30*b* as seen in the sheet discharge direction.

A guide hole 35 may be formed in each of side plates 3*c* of first sheet cassette 203 to be elongated along the sheet feed direction. A wing 57 may be formed on each side of bottom plate 30*a* of second sheet cassette 230 to extend close to an inner surface of each of side plates 3*c*. As shown in FIGS. 15 and 16, a round shaft 58 projecting from the downstream end of each of wings 57 toward the corresponding side plate 3*c* may be movably fitted into the corresponding guide hole 35. With this structure, second sheet cassette 230 is movable back and forth with respect to first sheet cassette 203 and is pivotable upward and downward about round shafts 58.

Two ribs 59*a*, 59*b* may be formed on an inner surface of each of side plates 3*c* at appropriate intervals in the moving direction of second sheet cassette 230. A projection 57*a* may be integrally formed with each of the wings 57 to provide a click feel when the user moves second sheet cassette 230 selectively back and forth, so that projections 57*a* pass beyond ribs 59*a*, 50*b*.

According to the first embodiment of the present invention, the sheet feed arm 6*a* extends toward the main inclined separation plate 8, and a downstream end portion 30*a*' of bottom plate 30*a* of the second sheet cassette 30 on which the sheets P1 are stacked, as seen in the sheet feed direction, may be formed to incline upward toward main inclined separation plate 8. With this structure, the inclination angle of sheet feed arm 6*a* with respect to the uppermost sheet surface may be maintained larger than a predetermined value, and thus, a force applied by the sheet feed roller 6*d* to the sheets P1 may be set optimally.

In the modified first sheet cassette 103 and second sheet cassette 130, a downstream end portion 30*a*' of bottom plate (holding portion) 30*a* of the second sheet cassette 130 on which the sheets P1 are stacked, as seen in the sheet feed direction, may be formed to incline upward toward auxiliary inclined separation plate 51. With this structure, the inclination angle of sheet feed arm 6*a* with respect to the uppermost sheet surface may be maintained larger than a predetermined value, and thus, a force applied by the sheet feed roller 6*d* to the sheets P1 may be set optimally.

According to the first embodiment of the present invention, when second sheet cassette 30 is moved to the sheet feed position on the downstream side, as seen in the sheet feed direction, with respect to the first sheet cassette 3, the sheet feed roller 6*d* is configured to contact the uppermost one of the sheets in the second sheet cassette 30. Accordingly, the sheets P1 in the second sheet cassette 30 at the sheet feed position may be reliably fed by the sheet feed roller 6*d*.

According to the second embodiment of the present invention, a range of inclination angle of sheet feed arm 6*a* and a range of inclination angle of sheet feed arm 60*a* may be selected to be substantially equal to each other and within a predetermined range. Accordingly, a force applied by the sheet feed roller 6*d*, 60*d* to the sheets P, P1 may be optimally set, thereby providing reliable sheet feeding. For example, even small-sized, thick postcards stacked in the second sheet cassette 130 may be reliably fed.

According to the second embodiment of the present invention, by the contact between cam followers 43, 61 and main cams 55 on side plates 3*c* of first sheet cassette 3, 203, respectively, the first sheet feeder 206 and the second sheet feeder 60 is movable up and down with respect to main inclined separation plate 8. By the contact between cam followers 43, 61 and auxiliary cams 44 on side plates 30*c* of the second sheet cassette 30, 230, respectively, first sheet feeder 206 and second sheet feeder 60 are movable up and down with respect to the sheets P, P1 in first sheet cassette 3, 203 and second sheet cassette 30, 230, respectively. Accordingly, first sheet cassette 3, 203 and second sheet cassette 30, 230 may be moved smoothly without contacting main inclined separation plate 8, first sheet feeder 206, or second sheet feeder 60.

In addition, according to the second embodiment of the present invention, each of first sheet feeder 206 and second sheet feeder 60 comprises sheet feed roller 6*b*, 60*b* and cam follower 43, 61. The cam followers 43, 61 of the first and second sheet feeders 206, 60 may be arranged in directions opposite to each other and perpendicular to the sheet feed direction. Main and auxiliary cams 55, 44 contactable with the cam follower 43 of the first sheet feeder 206 and main and auxiliary cams 55,44 contactable with cam follower 61 of second sheet feeder 60 may be formed separately at different positions of the first and second sheet cassette 203, 230. Accordingly, up and down movements of each of sheet feed rollers 6*b*, 60*b* may be individually controlled.

In addition, according to the second embodiment of the present invention, auxiliary cam 44 that contacts the cam follower 61 of the second sheet feeder 60 has such a shape that sheet feed roller 60*b* of second sheet feeder 60 is held at an upper position when second sheet cassette 230 is moved back to the upstream side as seen in the sheet feed direction with respect to first sheet cassette 203. Accordingly, sheet feed roller 60*b* for second sheet cassette 230 is prevented from being activated erroneously to feed the undesired sheets in second sheet cassette 230.

In addition, according to the second embodiment of the present invention, auxiliary cam 44 that contacts cam follower 43 of first sheet feeder 206 has such a shape that sheet feed roller 6*b* of first sheet feeder 206 is held at an upper position when second sheet cassette 230 is moved forth to the downstream side as seen in the sheet feed direction with respect to first sheet cassette 203. Accordingly, sheet feed roller 6*b* for first sheet cassette 203 is prevented from being activated erroneously to feed the undesired sheets in first sheet cassette 203.

In addition, according to the first and second embodiments of the present invention, second sheet cassette 30, 230 may be connected movably and pivotably to the guide hole 35 formed in side plates 3*c* of first sheet cassette 3, 203 to be elongated in the sheet feed direction. Accordingly, second sheet cassette 30, 230 is unlikely to come off first sheet cassette 3, 203, and readily may be inserted into and removed from housing 2 unitarily with first sheet cassette 3, 203.

In image recording apparatus 1 into which sheet feed device 100, 101 according to the first and second embodiments of the present invention may be incorporated, recording unit 7, sheet feed path 9*a*, and sheet feeder 6, 206, 60 are accommodated in housing 2, and first and second sheet cassettes 3, 30, 203, 230 are disposed at a lower position than recording unit 7 and are moveable inward and outward with respect to housing 2. Accordingly, sheets can be reloaded easily in the first and second sheet cassettes by pulling outward the first and second sheet cassettes set in housing 2.

In addition, image recording apparatus 1 may comprise media sensor 49 that detects the width of a sheet fed from the first and second sheet cassettes 3, 30, 203, 230 to recording unit 7, and cassette sensor 50 that detects the position of second sheet cassette 30, 230. Accordingly, image recording on a sheet of wrong size is prevented, and an erroneous sheet cassette setting at the sheet feed position is detected before recording, thereby avoiding wasting the sheet and the time required for sheet feed.

While the invention has been described in connection with preferred embodiments, it will be understood by those of ordinary skill in the art that other variations and modifications of the preferred embodiments described above may be made without departing from the scope of the invention. Other embodiments will be apparent to those skilled in the art from a consideration of the specification or practice of the invention disclosed herein. It is intended that the specification and the described examples only are considered as exemplary of the invention, with the true scope of the invention being defined by the following claims.

What is claimed is:

1. A sheet feed device comprising:

a first sheet cassette comprising a first bottom surface configured to hold a first plurality of sheets;

a second sheet cassette disposed on the first sheet cassette and comprising a second bottom surface configured to hold a second plurality of sheets, wherein at least one characteristic of the first plurality of sheets is different than at least one characteristic of the second plurality of sheets;

a sheet feeder comprising:

a sheet feed arm having a first end and a second end and configured to pivot about a pivot center at the first end, and a sheet feed roller mounted at the second end, wherein the sheet feed roller is configured to selectively feed the first plurality of sheets and the second plurality of sheets in a sheet feed direction toward a recording unit, and the sheet feed roller is located downstream from the pivot center in the sheet feed direction; and a sheet separator configured to separate, one by one, the sheets fed by the sheet feeder, wherein the second sheet cassette is configured to move relative to the first sheet cassette along the sheet feed direction between a first position and a second position, and the sheet feed roller is configured to contact a surface of the second plurality of sheets held on the second bottom surface when the second sheet cassette is in the first position, and a downstream portion of the second bottom surface downstream from the sheet feed roller in the sheet feed direction is inclined so as to increase in height in a direction toward the sheet separator.

2. The sheet feed device according to claim 1, wherein the first position is downstream from the second position in the sheet feed direction.

3. The sheet feed device according to claim 1, wherein the sheet feed roller contacts a surface of the first plurality of sheets held on the first bottom surface when the second sheet cassette is in the second position.

4. The sheet feed device according to claim 1, wherein the sheet feeder further comprises a drive shaft extending perpendicular to the sheet feed direction, and the sheet feed arm extends from the drive shaft toward a downstream side in the sheet feed direction.

5. The sheet feed device according to claim 1, wherein the second plurality of sheets are held on the second bottom surface while conforming to the inclination of the downstream portion of the second bottom surface.

6. The sheet feed device according to claim 1, wherein, when the second sheet cassette is in the first position, the sheet separator is located downstream from the downstream portion of the second bottom surface in the sheet feed direction.

7. The sheet feed device according to claim 1, wherein the sheet separator comprises a main inclined separation plate disposed at a downstream end of the first sheet cassette in the sheet feed direction, and the main inclined separation plate cooperates with the sheet feed roller to feed the second plurality of sheets on the second bottom surface one by one toward the recording unit when the second sheet cassette is in the first position, the holding portion being inclined so as to increase in height in a direction toward the main inclined separation plate.

8. The sheet feed device according to claim 1, wherein the sheet separator comprises an auxiliary inclined separation plate disposed at a downstream end of the second sheet cassette in the sheet feed direction, and when the second sheet cassette is in the first position, the auxiliary inclined separation plate cooperates with the sheet feed roller to feed the second plurality of sheets on the second bottom surface one by one toward the recording unit, the second bottom surface being inclined so as to increase in height in a direction toward the auxiliary inclined separation plate.

9. The sheet feed device according to claim 1, wherein the first sheet cassette further comprises side plates formed with guide holes extending in parallel with the sheet feed direction, and the second sheet cassette is connected at both sides of a downstream portion thereof in the sheet feed direction to the guide holes and is configured to move along the guide holes.

10. A sheet feed device comprising:

a first sheet cassette comprising an accommodating portion configured to accommodate a first plurality of sheets;

a second sheet cassette disposed on the first sheet cassette and comprising a holding portion configured to hold a second plurality of sheets, wherein at least one characteristic of the first plurality of sheets is different than at least one characteristic of the second plurality of sheets;

a first sheet feeder configured to feed the first plurality of sheets in a sheet feed direction toward a recording unit; and a second sheet feeder disposed side by side with the first sheet feeder in a direction perpendicular to the sheet feed direction, wherein the second sheet feeder is configured to feed the second plurality of sheets in the sheet feed direction to the recording unit, and each of the first sheet feeder and the second sheet feeder comprises:

a drive shaft extending in the direction perpendicular to the sheet feed direction;

a sheet feed arm extending from the drive shaft in the sheet feed direction; and a sheet feed roller provided at an end of the sheet feed arm, wherein a first length of the sheet feed arm of the second sheet feeder is less than a second length of the sheet feed arm of the first sheet feeder.

11. The sheet feed device according to claim 10, wherein an axial center of the drive shaft of the first sheet feeder and an axial center of the drive shaft of the second sheet feeder are substantially aligned with each other.

12. The sheet feed device according to claim 11, wherein a maximum loading height of the first plurality of sheets in the first sheet cassette is greater than a maximum loading height of the second plurality of sheets in the second sheet cassette.

13. The sheet feed device according to claim 10, further comprising a main inclined separation plate disposed at a downstream end of the first sheet cassette in the sheet feed direction, and the main inclined separation plate selectively cooperates with the sheet feed rollers of the first sheet feeder and the second sheet feeder to feed one by one the first plurality of sheets or the second plurality of sheets toward the recording unit.

14. The sheet feed device according to claim 10, wherein each of the first sheet feeder and the second sheet feeder further comprises a cam follower extending from the sheet feed arm along an axis of the drive shaft, wherein the first sheet cassette comprises, at upper surfaces of side plates thereof extending in the sheet feed direction, main cams configured to contact the cam followers of the first sheet feeder and the second sheet feeder, respectively, and the second sheet cassette comprises, at upper surfaces of side plates thereof extending in the sheet feed direction, auxiliary cams configured to contact the cam followers of the first sheet feeder and the second sheet feeder, respectively, and wherein the sheet feed rollers of the first sheet feeder and the second sheet feeder are configured to move up and down as the first sheet cassette moves unitarily with the second sheet cassette with respect to the first sheet feeder and the second sheet feeder and as the second sheet cassette is moved with respect to the first sheet cassette.

15. The sheet feed device according to claim 14, wherein the cam follower of the first sheet feeder and the cam follower of the second sheet feeder are arranged in directions opposite to each other and perpendicular to the sheet feed direction.

16. The sheet feed device according to claim 14, wherein a shape of the auxiliary cam that contacts the cam follower of the second sheet feeder is selected such that the sheet feed roller of the second sheet feeder is held at an upper position when the second sheet cassette is moved to an upstream side in the sheet feed direction with respect to the first sheet cassette.

17. The sheet feed device according to claim 14, wherein a shape of the auxiliary cam that contacts the cam follower of the first sheet feeder is selected such that the sheet feed roller of the first sheet feeder is held at an upper position when the second sheet cassette is moved to a downstream side in the sheet feed direction with respect to the first sheet cassette.

18. The sheet feed device according to claim 10, wherein the first sheet cassette further comprises side plates formed with guide holes extending in parallel with the sheet feed direction, and the second sheet cassette is connected at both sides of a downstream portion thereof in the sheet feed direction to the guide holes and is configured to move along the guide holes.

19. An image recording apparatus comprising:

a housing;

a recording unit that records an image on a sheet;

a sheet feed path through which the sheet is fed to the recording unit; and a sheet feed device, wherein the sheet feed device comprises:

a first sheet cassette comprising a first bottom surface configured to hold a first plurality of sheets;

a second sheet cassette disposed on the first sheet cassette and comprising a second bottom surface configured to hold a second plurality of sheets, wherein at least one characteristic of the first plurality of sheets is different than at least one characteristic of the second plurality of sheets;

a sheet feeder comprising:

a sheet feed arm having a first end and a second end and configured to pivot about a pivot center at the first end, and a sheet feed roller mounted at the second end, wherein the sheet feed roller is configured to selectively feed the first plurality of sheets and the second plurality of sheets in a sheet feed direction toward a recording unit, and the sheet feed roller is located downstream from the pivot center in the sheet feed direction; and a sheet separator configured to separate, one by one, the sheets fed by the sheet feeder, wherein the second sheet cassette is configured to move relative to the first sheet cassette along the sheet feed direction between a first position and a second position, and the sheet feed roller is configured to contact a surface of the second plurality of sheets held on the second bottom surface when the second sheet cassette is in the first position, and a downstream portion of the second bottom surface downstream from the sheet feed roller in the sheet feed direction is inclined so as to increase in height in a direction toward the sheet separator.

20. The image forming apparatus according to claim 19, further comprising:

a media sensor configured to detect a width of the sheets fed from the first sheet cassette and the second sheet cassette, respectively, to the recording unit; and a cassette sensor configured to detect a position of the second sheet cassette, wherein the media sensor and the cassette sensor are provided in the housing to prevent image recording on a sheet that is fed from an undesignated one of the first sheet cassette and the second sheet cassette and has an undesignated size.

21. An image recording apparatus comprising:

a housing;

a recording unit that records an image on a sheet;

a sheet feed path through which the sheet is fed to the recording unit; and a sheet feed device, wherein the sheet feed device comprises:

a first sheet cassette comprising an accommodating portion configured to accommodate a first plurality of sheets;

a second sheet cassette disposed on the first sheet cassette, wherein the second sheet cassette comprises a holding portion configured to hold a second plurality of sheets, and at least one characteristic of the first plurality of sheets is different than at least one characteristic of the second plurality of sheets;

a first sheet feeder configured to feed the first plurality of sheets in a sheet feed direction toward a recording unit; and a second sheet feeder disposed side by side with the first sheet feeder in a direction perpendicular to the sheet feed direction, wherein the second sheet feeder is configured to feed the second plurality of sheets in the sheet feed direction to the recording unit, and each of the first sheet feeder and the second sheet feeder comprises:

a drive shaft extending in the direction perpendicular to the sheet feed direction;

a sheet feed arm extending from the drive shaft in the sheet feed direction; and a sheet feed roller provided at an end of the sheet feed arm, wherein a first length of the sheet feed arm of the second sheet feeder is less than a second length of the sheet feed arm of the first sheet feeder, and the recording unit, the sheet feed path, and the sheet feeder of the sheet feed device are accommodated in the housing, wherein the first sheet cassette and the second sheet cassette are disposed at a lower position than the recording unit and are configured to move inward and outward with respect to the housing.

22. The image forming apparatus according to claim 21, further comprising:

a media sensor configured to detect a width of the sheets fed from the first sheet cassette and the second sheet cassette, respectively, to the recording unit; and a cassette sensor configured to detect a position of the second sheet cassette, wherein the media sensor and the cassette sensor are provided in the housing to prevent image recording on a sheet that is fed from an undesignated one of the first sheet cassette and the second sheet cassette and has an undesignated size.

* * * * *